US007224920B2

(12) United States Patent
Koyama

(10) Patent No.: US 7,224,920 B2
(45) Date of Patent: May 29, 2007

(54) SHEET PROCESSING APPARATUS AND CONTROL METHOD THEREOF

(75) Inventor: Satoru Koyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 132 days.

(21) Appl. No.: 11/044,293

(22) Filed: Jan. 28, 2005

(65) Prior Publication Data

US 2005/0135830 A1 Jun. 23, 2005

(30) Foreign Application Priority Data

Feb. 6, 2003 (JP) ..... 2004-031403

(51) Int. Cl.
*G03G 15/00* (2006.01)

(52) U.S. Cl. ..... 399/89; 399/407

(58) Field of Classification Search ..... 399/88
See application file for complete search history.

(56) References Cited

U.S. PATENT DOCUMENTS 5,094,379 A 3/1992 Hoyer et al. ..... 227/2
5,471,283 A * 11/1995 Irihara et al. ..... 399/18
5,923,939 A 7/1999 Koyama ..... 399/308
6,371,471 B1 * 4/2002 Fukazu et al. ..... 270/58.09
6,542,705 B2 * 4/2003 Fujita et al. ..... 399/69
6,941,088 B2 * 9/2005 Atsushi et al. ..... 399/69
2003/0063918 A1 * 4/2003 Miura ..... 399/90
2004/0141767 A1 * 7/2004 Hiroto ..... 399/88
2005/0058467 A1 * 3/2005 Sasamoto et al. ..... 399/67
2005/0169655 A1 8/2005 Koyama et al. ..... 399/69
2005/0169657 A1 8/2005 Hanamoto et al. ..... 399/88
2005/0169658 A1 8/2005 Hanamoto et al. ..... 399/88
2005/0169659 A1 8/2005 Koyama et al. ..... 399/88

FOREIGN PATENT DOCUMENTS

JP 11-322181 11/1999

* cited by examiner

*Primary Examiner*—Andrew H. Hirshfeld
*Assistant Examiner*—Jeff Natalini
(74) *Attorney, Agent, or Firm*—Fitzpatrick, Cella, Harper & Scinto

(57) ABSTRACT

In a sheet processing apparatus, which is connected to an image forming apparatus, applies a predetermined process to a plurality of sheets that have undergone image formation as a unit, and has power storage means capable of storing electric power required to execute the process, the output voltage from the power storage means is detected, and when the detected voltage exceeds a predetermined value, the process is controlled to execute the process using the electric power stored in the power storage means in accordance with an instruction from the image forming apparatus. Since the process is executed using the electric power supplied from the power storage means, consumption power can be prevented from temporarily increasing upon execution of the process.

20 Claims, 15 Drawing Sheets

SHEET PROCESSING APPARATUS AND CONTROL METHOD THEREOF

FIELD OF THE INVENTION

The present invention relates to a sheet processing apparatus and a control method thereof and, more particularly, to execution control of processes in a sheet processing apparatus which is connected to an image forming apparatus, applies a predetermined process for a plurality of sheets that have undergone image formation as a unit, and has a power storage means which can store electric power required to execute the process.

BACKGROUND OF THE INVENTION

Currently, apparatuses which form images according to an electrophotography system have been prevalently used. For example, laser beam printers which form (print) images on cut sheets, OHP sheets, and the like on the basis of an image signal sent from a host apparatus such as a computer or the like have prevailed, and some models of such printers have a staple function of stapling a set (bundle) of sheets (recording media) on which images are formed.

Such staple function is normally provided by a sheet processing apparatus which is connected to an image processing apparatus upon use, and Japanese Patent Laid-Open No. 11-322181 describes such sheet processing apparatus.

A conventional image forming apparatus and a conventional sheet processing apparatus will be described below with reference to FIGS. 10 to 15. FIG. 10 is a schematic sectional view showing the structure of an image forming apparatus, FIG. 11 is a view for explaining a scanner unit, FIG. 12 is a schematic sectional view showing the structure of a sheet processing apparatus, FIG. 13 is a top view of the sheet processing apparatus, FIG. 14 is a block diagram showing electrical connections between the image forming apparatus and sheet processing apparatus, and FIG. 15 is a graph schematically showing a change in consumption current in the sheet processing apparatus.

The image forming operation of an image forming apparatus 301 of this prior art will be described below mainly with reference to FIGS. 10 and 11. Reference numeral 101 denotes an image signal (VDO signal), which is input to a laser unit 102. Reference numeral 103 denotes a laser beam which is ON/OFF-modulated by the laser unit 102. Reference numeral 104 denotes a scanner motor, which steadily rotates a rotary polygonal mirror 105. Reference numeral 106 denotes an imaging lens which forms a focal point of a laser beam 107 deflected by the polygonal mirror on a photosensitive drum 108 as a surface to be scanned.

Therefore, the laser beam 107 modulated based on the image signal 101 is horizontally scanned (in the main scan direction) on the photosensitive drum 108. Reference numeral 109 denotes a beam detection port which fetches the beam via a slit-like entrance port. The laser beam which has entered via this entrance port is guided to a photoelectric conversion element 111 via an optical fiber 110. The laser beam which is converted into an electrical signal by the photoelectric conversion element 111 is amplified by an amplifier circuit (not shown) to obtain a horizontal sync signal.

A latent image formed on the photosensitive drum 108 is visualized by a developer 123 to obtain a toner image, which is transferred onto a transfer sheet 112 by a transfer roller 120.

Reference numeral 131 denotes a paper cassette which feeds one type of standard-size transfer sheets of a size selected from an A4 size, LETTER size, and the like.

A single-sided print operation on the transfer sheet 112 fed from the paper cassette 131 will be explained below.

When a pickup roller 132 makes one revolution, one of transfer sheets 112 on the multi-tray (paper cassette) 131 is fed to paper feed rollers 134. The transfer sheet 112 is fed to registration rollers 135 upon rotation of the paper feed rollers 134, and stands by for synchronization with an image forming unit.

A registration sensor 137 as a combination of a photointerrupter (light transmitting sensor) and flag processing is arranged in the vicinity of the registration rollers 135, and detects that the leading end of the transfer sheet 112 arrives the registration roller 135.

An image forming apparatus control circuit 402 (FIG. 14) that controls the image forming unit detects the arrival timing of the leading end of the transfer sheet 112 to the registration rollers 135 on the basis of the detection result of the registration sensor 137, starts image formation on the photosensitive drum 108 and controls the temperature of a halogen heater (not shown) of a fixing unit 121 to a predetermined value.

The transfer sheet 112 which stands by at the position of the registration rollers 135 is conveyed in synchronism with the timing of the detection result of the registration sensor 137 and the image forming process, and a toner image formed on the photosensitive drum 108 is transferred onto the transfer sheet 112 by a transfer roller 120. The transfer sheet 112 on which the toner image has been transferred is fixed by the fixing unit 121 which incorporates a halogen heater, and is guided to an discharge unit 122 as the upper portion of the image forming apparatus via discharge rollers 140 and a flapper 141 set at the a side, and is discharged from the discharge unit 122 by discharge rollers 156.

On the other hand, a sheet processing apparatus 302 is connected as an option to the image forming apparatus 301, and the following control is made to discharge a sheet to the sheet processing apparatus 302.

When the sheet processing apparatus 302 is connected to the image forming apparatus 301 and a connected host computer or the like (not shown) issues an discharge instruction to the sheet processing apparatus, the image forming apparatus control circuit 402 sets the flapper 141 to the b side, and conveys the transfer sheet 112 into the sheet processing apparatus 302 by the discharge rollers 140 after the printed transfer sheet 112 has passed the fixing unit 121. The transfer sheet 112 that has undergone image formation by the image forming apparatus main body 301 is passed to the sheet processing apparatus 302 connected as an option with its obverse surface facing up (face up).

As shown in FIG. 14, a sheet processing apparatus control circuit 409 in the sheet processing apparatus 302 is connected to the image forming apparatus control circuit 402 in the image forming apparatus main body to communicate with each other. When the image forming apparatus control circuit 402 issues a staple instruction for stapling a set of a plurality of transfer sheets, the sheet processing apparatus control circuit 409 conveys the transfer sheet 112 to a stack tray used to staple it intact or while being reversed by a reverse mechanism in a stacker. The transfer sheet 112 conveyed to the stack tray is aligned in the convey direction and widthwise direction by an aligning plate until a predetermined number of transfer sheets 112 are conveyed. When a set of a predetermined number of transfer sheets is formed, a shutter is closed to fix and staple the set of transfer sheets.

The set of transfer sheets 112 stapled by the stapler is discharged onto the discharge tray by driving discharge rollers.

The staple operation in the sheet processing apparatus 302 will be described below mainly with reference to FIGS. 12 to 14.

Reference numeral 303 denotes an entrance sensor which detects the transfer sheet 112 fed from the image forming apparatus main body 301. The detection information of the transfer sheet 112 by the entrance sensor 303 is input to the sheet processing apparatus control circuit 409. Upon reception of this information, the sheet processing apparatus control circuit 409 drives a transfer sheet convey motor (not shown). When the transfer sheet convey motor is driven, entrance rollers 304, reverse rollers 310, a slip roller 306, and a pair of set convey rollers (set convey means) 305 are simultaneously driven.

The reverse rollers 309 are initially rotated to convey the transfer sheet 112 in the feed direction. However, when a reverse solenoid works in response to a signal output from the sheet processing apparatus control circuit 409, the rotation direction of the rollers 309 is reversed to convey the transfer sheet 112 in the reverse direction. Reference numeral 308 denotes a flapper which is controlled by the sheet processing apparatus control circuit 409. When a flapper solenoid (not shown) operates, the transfer sheet 112 is fed into the convey rollers 310 facing up, and forms a transfer sheet set 112*a* on a stack tray (stack means) 318.

The pair of convey rollers 305 normally contact the convey path surface. When a set convey roller solenoid (not shown) controlled by the sheet processing apparatus control circuit 409 is driven, the upper roller of the rollers 305 moves upward to a set convey roller upper position 305*a* where that roller does not contact the convey path surface. While the set convey roller solenoid is driven, a shutter 307 is closed.

When the transfer sheets 112 are stacked on the stack tray 318 to staple the transfer sheet set 112*a*, the set convey roller solenoid is driven to move the upper one of the set convey rollers to the position 305*a*, and to close the shutter 307.

The slip roller 306 has a very weak convey force. The roller 306 conveys the sheet until the leading end of the sheet contacts the shutter 307, and slips on the sheet so as to align the sheet leading end and to hold the sheet position after the sheet leading end contacts the shutter 307. When the transfer sheet 112 begins to be stacked, a stack tray sheet sensor 313 detects the sheet and inputs a detection signal to the sheet processing apparatus control circuit 409. An alignment means that aligns the leading end portions of the transfer sheets 112 is formed.

When the transfer sheets 112 are to be stacked at the position of the shutter 307, aligning plates R 402 and L 403 are moved in the widthwise direction in correspondence with the size of the transfer sheets 112. The aligning plates R 402 and L 403 are controlled by the sheet processing apparatus control circuit 409 via an aligning plate motor drive circuit (not shown) and are driven by aligning plate R and L motors (neither are shown).

The moving positions of the aligning plates R 402 and L 403 are controlled by determining moving amounts from aligning plate R and L home position sensors (not shown) by the sheet processing apparatus control circuit 409 on the basis of the transfer sheet size which is sent from the image forming apparatus control circuit 402 via a communication line.

When a predetermined number of transfer sheets 112 are stacked, the image forming apparatus control circuit 402 issues a staple designation to the sheet processing apparatus control circuit 409. Upon reception of the staple designation, the sheet processing apparatus control circuit 409 moves a staple unit 312 in the widthwise direction indicated by the double-headed arrows, and drives a staple motor (not shown) in a staple drive unit 410, thus stapling the transfer sheet set 112*a*. The staple unit 312 is moved by driving a stapler moving motor (not shown) controlled by the sheet processing apparatus control circuit 409. The moving amount of the staple unit 312 is controlled by the sheet processing apparatus control circuit 409 on the basis of the moving distance from a stapler unit home position sensor (not shown).

Whether or not the operation of a stapler 312*a* of the staple unit 312 normally ends can be confirmed when a staple cam returns to the position of the staple home position sensor a predetermined period of time after the sheet processing apparatus control circuit 409 begins to drive the staple motor. When the shutter 307 is opened before the transfer sheet set 112*a* is stapled, and the transfer sheet set 112*a* is stapled after it is conveyed by a predetermined distance, the transfer sheet set 112*a* can be stapled at an arbitrary position in the convey direction.

A pair of discharge rollers (set discharge means) R 406 and L 407 are arranged near downstream of the shutter 307. Reference numeral 317 denotes an discharge sensor which is equipped on an discharge tray (sheet set stack means) 316, and inputs a sensor signal to the sheet processing apparatus control circuit 409.

In the conventional image forming apparatus 301 and sheet processing apparatus 302 as an option, a power supply circuit 401 for the image forming apparatus and a power supply circuit 415 for the sheet processing apparatus are independently provided, and are connected to a commercial power supply via AC plugs 411 and 414, thus operating the image forming apparatus 301 and sheet processing apparatus 302.

The reason why commercial power is supplied to the respective power supply circuits is that the sheet processing apparatus 302 requires large power in the staple operation, as shown in FIG. 15, and it is not practical to design the power supply circuit 401 for the image forming apparatus main body 301 as a large-capacity power supply circuit in consideration of the load on the sheet processing apparatus 302.

In FIG. 15, a current Is1 that requires normal operations such as a sheet convey operation and the like of the sheet processing apparatus is as relatively small as about 24 V/1 A. However, when the staple operation is done, a maximum current Is3 as high as 5 A flows for about 100 msec. In order to supply electric power from the image forming apparatus to the sheet processing apparatus in consideration of electric power based on this maximum current Is3, the output electric power of the power supply for the image forming apparatus must be set as high as about 120 W(=24 V×5 A). As a result, a large-scale, expensive power supply circuit is required, resulting in an increase in price which is unnecessary for users who use only the image forming apparatus (does not require any sheet processing apparatus).

For this reason, conventionally, since the power supply circuit 401 for the image forming apparatus 301 and the power supply circuit 415 for the sheet processing apparatus 302 are independently provided, minimum required portions (e.g., a communication interface and the like) are provided to the image forming apparatus main body for the sheet processing apparatus as an option, thus suppressing an increase in cost.

On the other hand, as one of reasons why the power supply circuits are independently provided, an image forming apparatus that requires a sheet processing apparatus is normally limited to a large-scale, high value-added image forming apparatus such as a monochrome high-speed printing machine, a high image quality machine that can perform color print, and the like.

More specifically, the power supply circuits are independently provided for the following reasons: two AC plugs are agreeable in terms of design since a system formed by connecting the image forming apparatus to the sheet processing apparatus as an option is bulky; even when the total AC current that flows in the system of the image forming apparatus and sheet processing apparatus exceeds maximum allowable electric power (e.g., 1,500 W) of one commercial power supply system, since the system is installed by a service person, the service person need only connect the two AC plugs to different commercial power supply systems so as not to exceed the maximum allowable electric power of the commercial power supply; and so forth.

In recent years, along with the improvements of the technologies of image forming apparatuses, image forming apparatuses which belong to a category of middle-speed machines (middle-class machines) have been speeded up while their size and price reductions are achieved, and have gained a speed comparable to that of conventional high-speed machines. Based on such improvements, added values such as expandability of options, energy savings, and the like are demanded from the market more strongly.

Under such circumstances, a demand is increasing for an image forming apparatus which can improve its design upon mounting an option and allows the user to easily attach/detach an option by supplying electric power from the image forming apparatus to an option apparatus.

However, when electric power is supplied from the power supply in the image forming apparatus main body to the sheet processing apparatus such as a staple stacker or the like, the staple operation requires large electric power, as described above. For this reason, a large-capacity power supply circuit must be prepared in the image forming apparatus main body in consideration of consumption power in the sheet processing apparatus. However, this arrangement results in an increase in price unnecessary for users who use only the image forming apparatus. In order to meet such conflicting requisites, it is demanded to reduce electric power to be supplied to the sheet processing apparatus and to minimize an increase in cost of the image forming apparatus main body.

In a large-scale, high value-added image forming apparatus such as a monochrome high-speed printing machine, a high image quality machine that can perform color print, and the like, i.e., in a so-called high-speed machine (high-class machine), more functions are required, and consumption power tends to increase although energy-saving measures are taken. One indication of the upper limit of electric power consumed by these apparatuses is the maximum electric power (e.g., 1,500 W=100 V×15 A if the commercial power supply voltage is 100 V) that can be supplied by the commercial power supply.

In general, the image forming apparatus main body is normally designed so that the maximum electric power of the apparatus does not exceed that of the commercial power supply. Therefore, when an option such as the sheet processing apparatus that consumes relatively large electric power or the like is connected to the image forming apparatus whose maximum electric power is approximate to that of the commercial power supply, it is recommended that a power supply circuit is independently provided to the sheet processing apparatus, and is connected to a commercial power supply system different from the main body using an AC plug different from the image forming apparatus main body.

However, the AC plugs of the image forming apparatus main body and sheet processing apparatus are often connected to the same commercial power supply system unless they are connected by a service person or the like in consideration of the maximum consumption power. Therefore, it is demanded to reduce the maximum electric power of each of the image forming apparatus and sheet processing apparatus so as to prevent protection means such as the circuit breaker of the commercial power supply from operating even when the two AC plugs are connected to the same commercial power supply system, and to prevent the maximum electric power of the system from exceeding the maximum electric power that can be supplied by one commercial power supply system.

SUMMARY OF THE INVENTION

It is an object of the present invention to reduce the peak of consumption power in a sheet processing apparatus and to reduce cost as a whole.

In order to achieve the above object, according to one aspect of the present invention, there is provided a sheet processing apparatus, which is connected to an image forming apparatus, and applies a predetermined process to a plurality of sheets that have undergone image formation as a unit, comprising: power storage means capable of storing electric power required to execute the process; a charge circuit for charging the power storage means with electric power; a detection circuit for detecting an output voltage of the power storage means; and a control circuit for, when the voltage detected by the detection circuit exceeds a predetermined value, controlling the process to be executed by using the electric power stored in the power storage means in accordance with an instruction from the image forming apparatus.

In order to achieve the above object, according to another aspect of the present invention, there is provided a method of controlling a sheet processing apparatus, which is connected to an image forming apparatus, applies a predetermined process to a plurality of sheets that have undergone image formation as a unit, and has power storage means capable of storing electric power required to execute the process, comprising: a charge step of charging the power storage means with electric power; a detection step of detecting an output voltage of the power storage means; and a control step of controlling, when the voltage detected in the detection step exceeds a predetermined value, the process to be executed by using the electric power stored in the power storage means in accordance with an instruction from the image forming apparatus.

That is, in the sheet processing apparatus which is connected to the image forming apparatus, applies a predetermined process for a plurality of sheets that have undergone image formation as a unit, and has a power storage means which can store electric power required to execute the process, the power storage means is charged with electric power, the output voltage of the power storage means is detected, and when the detected voltage exceeds a predetermined value in accordance with an instruction from the image forming apparatus, the process is executed using electric power stored in the power storage means.

In this way, since the process is executed using electric power supplied from the power storage means, consumption power can be prevented from temporarily increasing upon executing the process.

Therefore, the peak of consumption power of the sheet processing apparatus can be reduced, and installation of a system including the image processing apparatus and sheet processing apparatus is facilitated. In addition, the capacity of the power supply provided to the sheet processing apparatus or image processing apparatus can be reduced, and the cost of the overall system including the sheet processing apparatus or the image processing apparatus can be reduced.

The charge circuit may be configured to charge the power storage means with electric power supplied from the image forming apparatus.

The charge circuit may further comprises a power supply circuit for generating internally required electric power from a commercial power supply, and the charge circuit may be configured to charge the power storage means with electric power supplied from the power supply circuit.

The control circuit may control a route of electric power supplied from the power storage means so as to prevent the charge process on the power storage means by the charge circuit, and execution of the process from being made at the same time.

When the voltage detected by the detection is not greater than the predetermined value, the control circuit may instruct the image forming apparatus to pause an image forming operation without executing the process.

Otherwise, when the voltage detected by the detection circuit is not greater than the predetermined value, and when the detected voltage exceeds a second predetermined value less than the predetermined value and the number of sheets as the unit exceeds a predetermined value, the control circuit may execute the process.

In this case, when the voltage detected by the detection circuit is not greater than the predetermined value, and when the detected voltage exceeds a second predetermined value less than the predetermined value or the number of sheets as the unit is not greater than a predetermined value, the control circuit may instruct the image forming apparatus to pause an image forming operation, and then execute the process using the electric power supplied to the charge circuit. Otherwise, when the voltage detected by the detection circuit is not greater than the predetermined value, and when the detected voltage exceeds a second predetermined value less than the predetermined value and the number of sheets as the unit is not greater than a predetermined value, the control circuit may instruct the image forming apparatus to delay an image forming operation, and then execute the process.

The process may be one of a staple process for stapling the plurality of sheets, a trimming process for trimming the plurality of sheets, and a booklet process for bookbinding the plurality of sheets.

The power storage means may comprise a capacitor or a secondary battery, and the capacitor may be an electric double layer capacitor.

Note that the above object is also achieved by an image forming system including the aforementioned sheet processing apparatus and image forming apparatus, a computer program that makes a computer apparatus execute the method of controlling the sheet processing apparatus, and a storage medium storing that computer program.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings. Note that each element in the following elements is not intended to limit the scope of the invention, but is described only as an example.

First Embodiment

The first embodiment according to the present invention will be described in detail hereinafter with reference to FIGS. 1 to 6.

Figure 1:
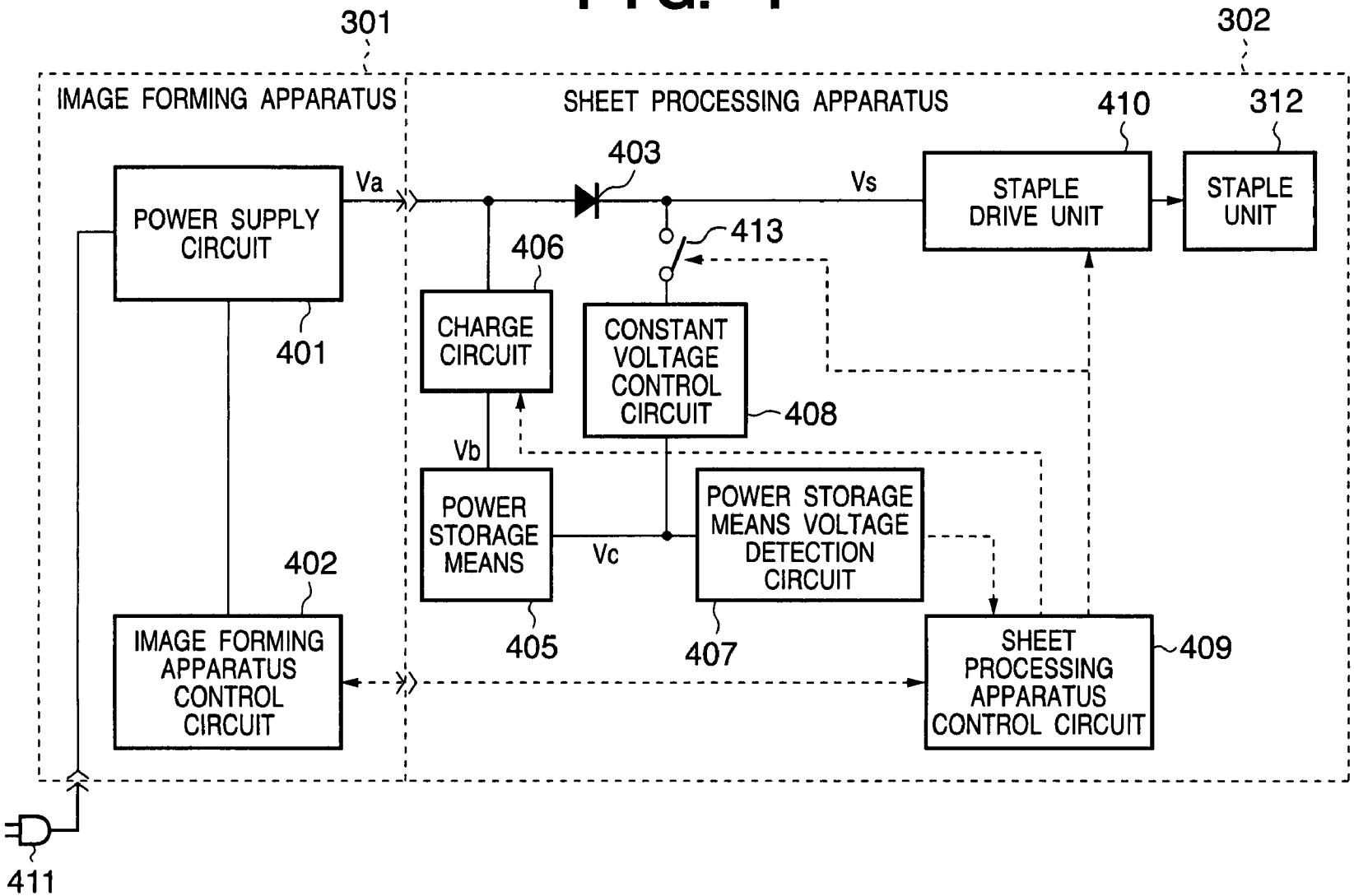
FIG. 1 is a block diagram showing the electrical arrangement of an image forming apparatus and sheet processing apparatus according to the first embodiment of the present invention.
Figure 2:
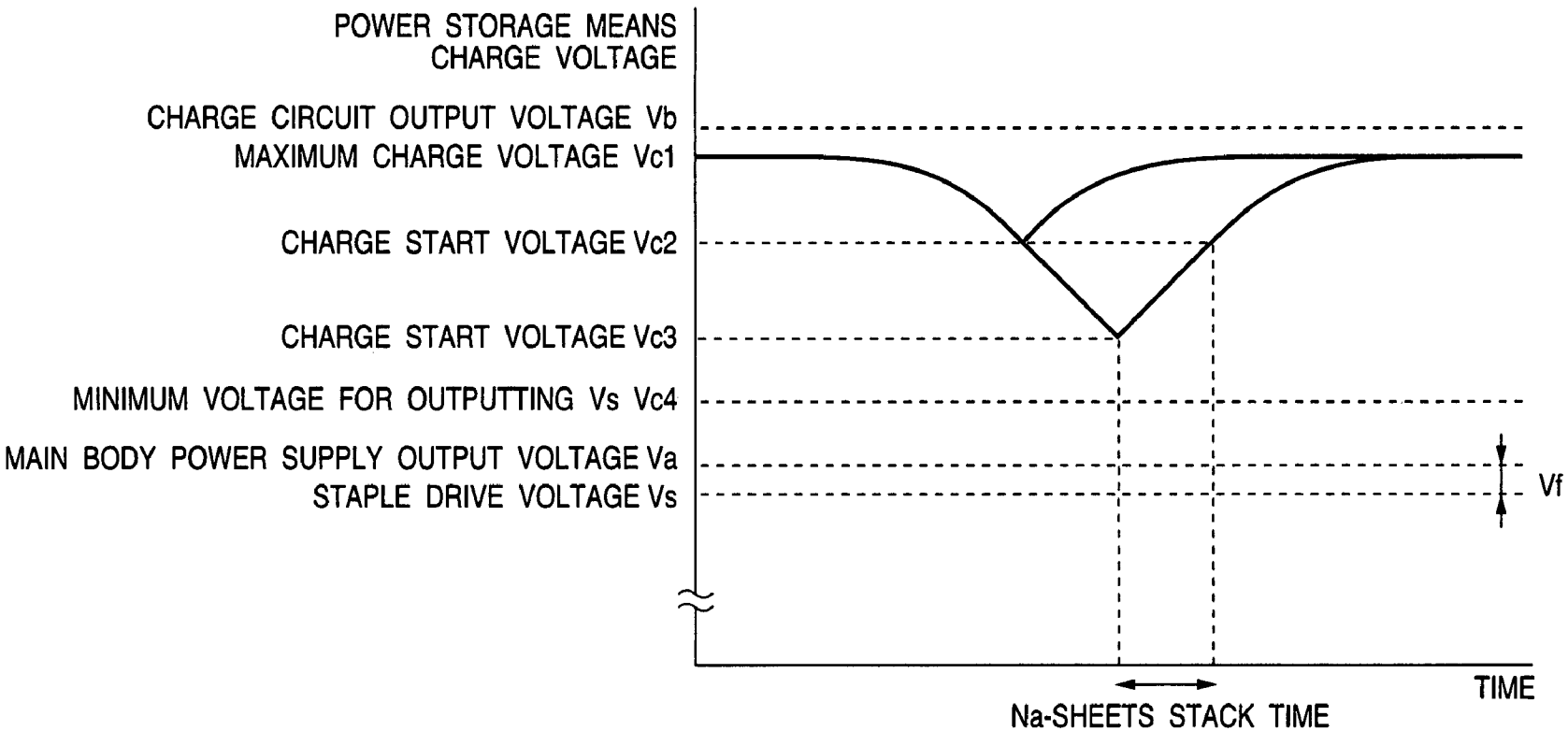
FIG. 2 is a graph showing an example of a change in output voltage of a power storage means.
Figure 3:
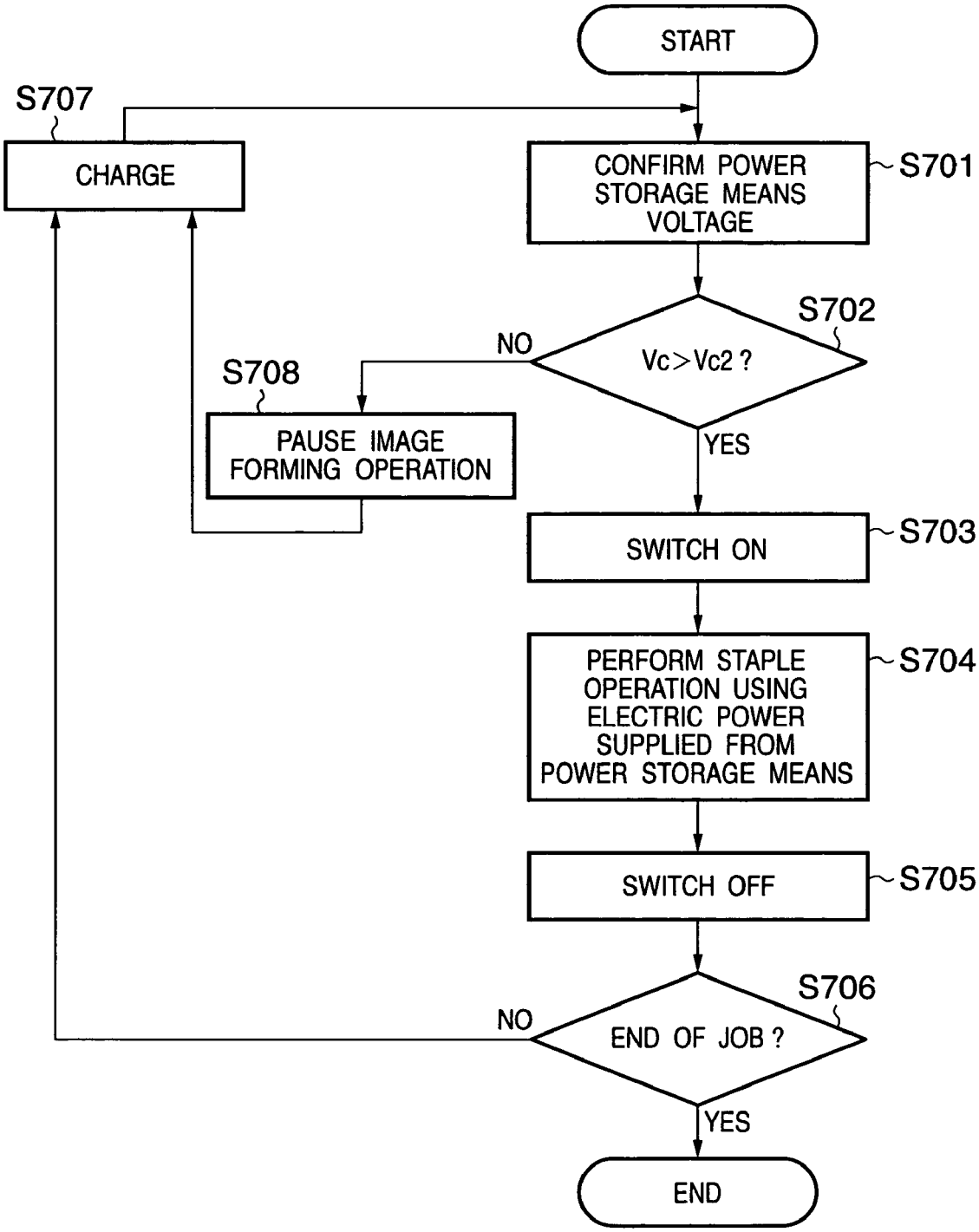
FIG. 3 is a flowchart of a staple process of the first embodiment.
Figure 4:
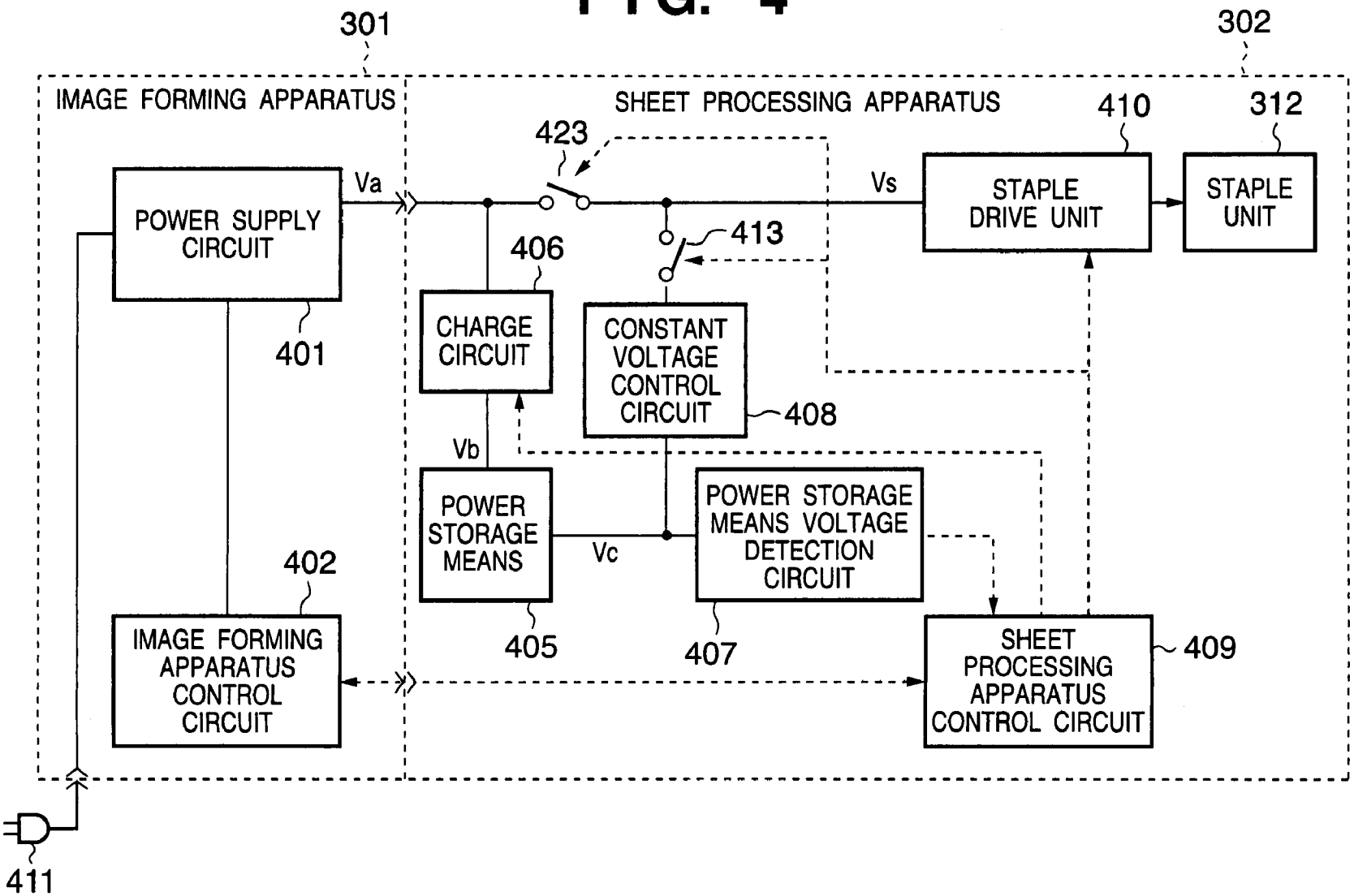
FIG. 4 is a block diagram showing the arrangement of a modification of the first embodiment.
Figure 5:
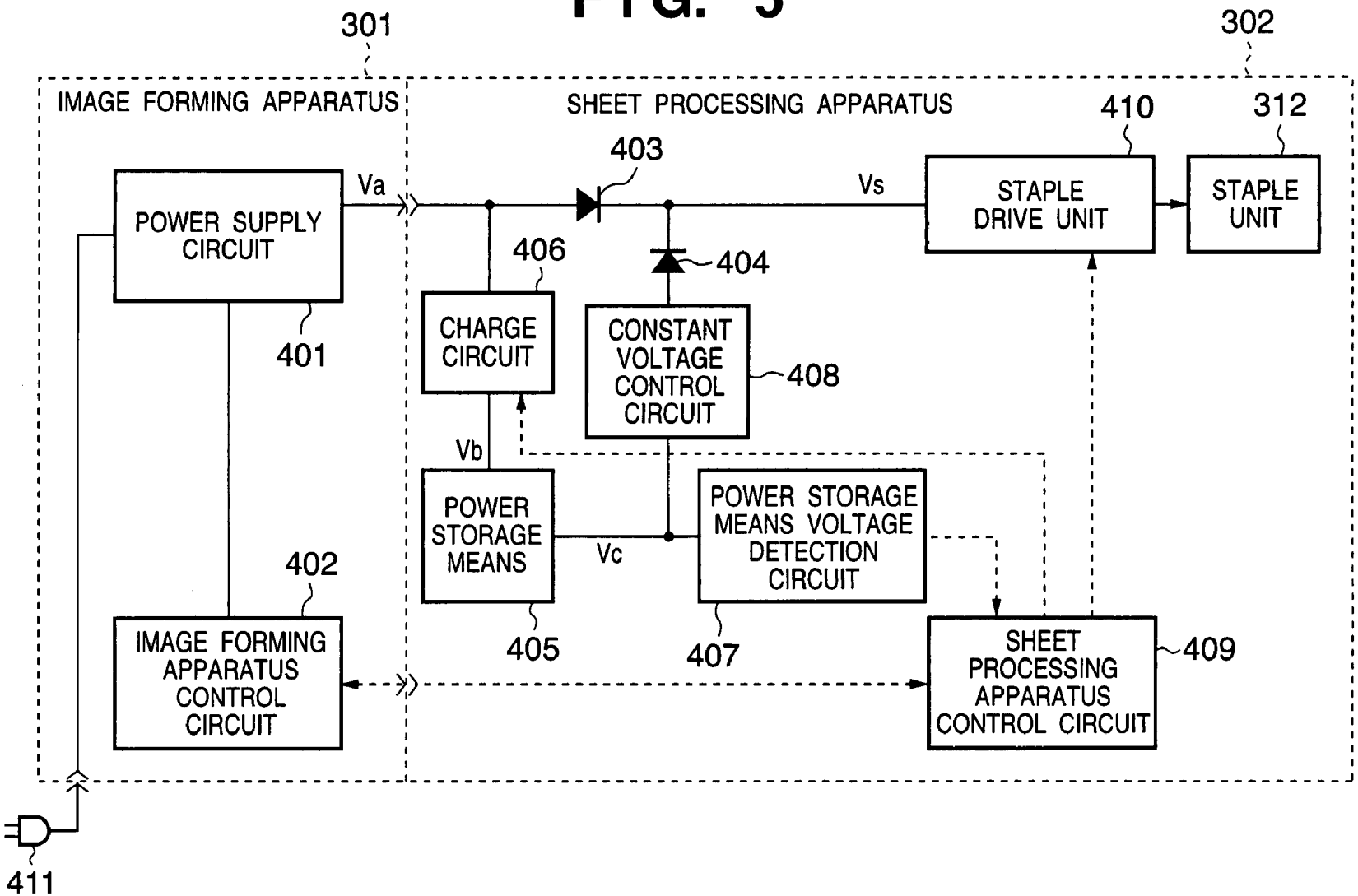
FIG. 5 is a block diagram showing the arrangement of another modification of the first embodiment.
Figure 6:
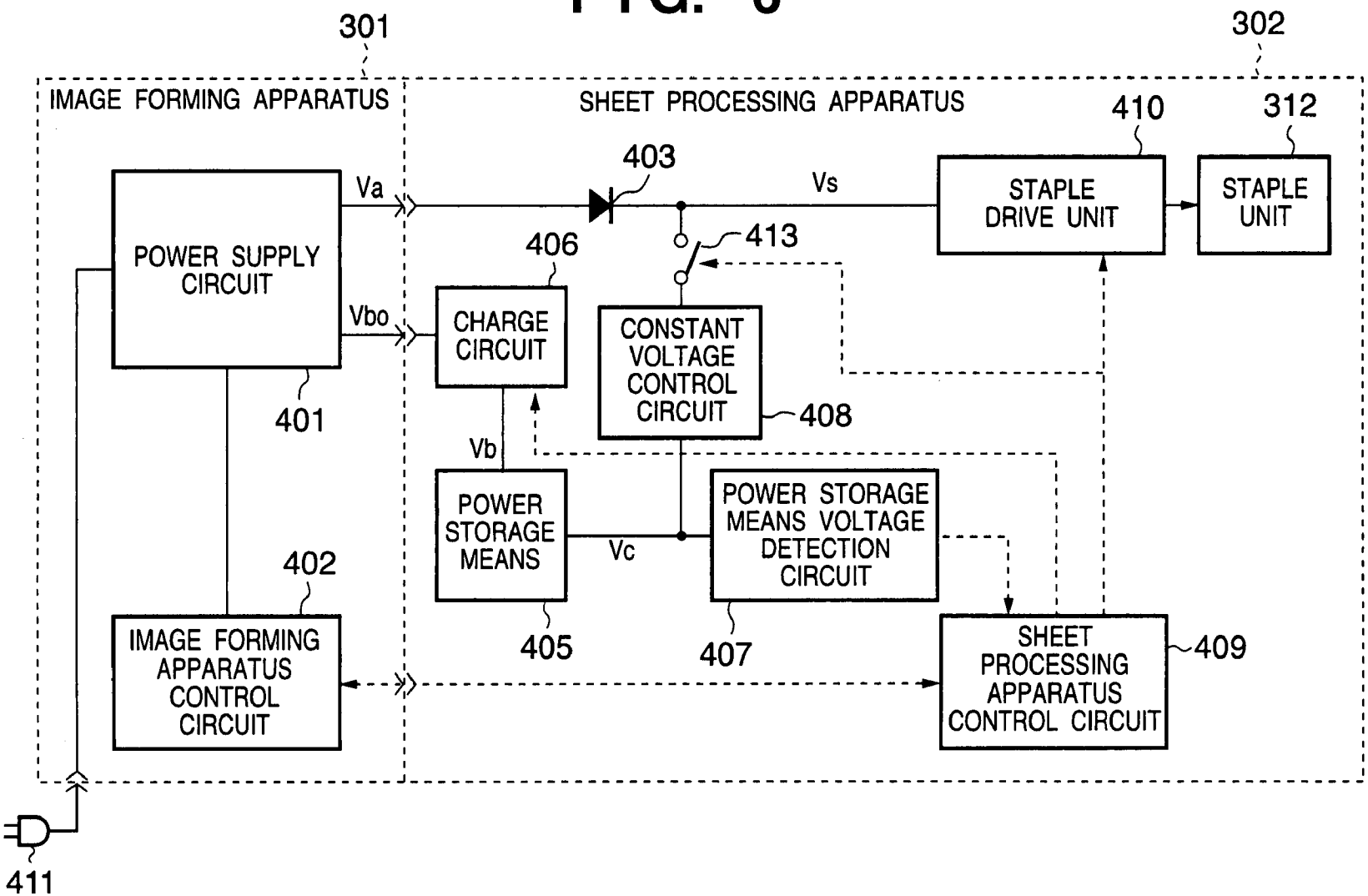
FIG. 6 is a block diagram showing the arrangement of still another modification of the first embodiment.

FIG. 1 is a block diagram showing the electrical control arrangement of an image forming apparatus and sheet processing apparatus, FIG. 2 is a graph showing a change in output voltage of a power storage means, FIG. 3 is a flowchart showing the operation of the first embodiment, and FIGS. 4 to 6 are block diagrams showing other arrangements of the first embodiment.

The image forming operation of the image forming apparatus, and the operation of the sheet processing apparatus are the same as those in the prior art mentioned above, and a description thereof will be omitted. Also, the same reference numerals denote the same parts as in the prior art, and a detailed description thereof will be omitted.

A power supply circuit 401 is provided to an image forming apparatus 301 to supply a predetermined voltage to an image forming apparatus control circuit 402 that controls image formation, and to supply a predetermined voltage Va to a sheet processing apparatus 302 set as an option via a connector. The image forming apparatus control circuit 402 communicates, via a connector, with a sheet processing apparatus control circuit 409, which is arranged in the sheet processing apparatus 302, and controls the convey and staple operations of transfer sheets in the sheet processing apparatus, thus making timing control so that the convey and staple operations of transfer sheets 112 conveyed from the image forming apparatus 301 can be made smoothly.

Reference numeral 406 denotes a charge circuit, which receives the voltage Va supplied from the power supply circuit 401 of the image forming apparatus, supplies a predetermined voltage Vb(Va<Vb) to a power storage means 405 including a plurality of electric double layer capacitors in accordance with a charge command from the sheet processing apparatus control circuit 409, and changes until the output voltage of the power storage means reaches a predetermined voltage Vc(≈Vb). The electric double layer capacitor has received a lot of attention in many fields in recent years, since it has a capacitance as large as several F or more, higher charge efficiency than a secondary battery, and a long life.

A power storage means voltage detection circuit 407 detects the charge voltage of the power storage means 405, and transmits the detection result to an A/D port of a CPU (not shown) in the sheet processing apparatus control circuit 409 as, e.g., an analog signal. According to this voltage detection result of the power storage means, the sheet processing apparatus control circuit 409 supplies a charge instruction to the charge circuit 406. A constant voltage control circuit 408 controls the charge voltage Vc of the power storage means 405 to be equal to or higher than a voltage Vs(Vs≈Va−Vf, Vs<Vc, Vf=forward voltage of a diode 403: about 0.6 V), and supplies the voltage Vs to a staple drive unit 410 via a switch 413, thereby driving a staple unit 312.

As the switch 413, a semiconductor switch such as a FET or the like is preferably used in terms of durability of ON/OFF operations. However, a mechanical switch such as a relay or the like may be used if it does not pose any problem in a service life such as ON/OFF counts and the like. A diode 403 is provided to prevent the output from the power supply circuit 401 of the image forming apparatus from being supplied to the staple drive circuit 410, while the voltage Vs is supplied from the power storage means 405 via the constant voltage control circuit 408.

Therefore, the diode 403 may be replaced by a switch 423, as shown in FIG. 4, and the switch 413 may be controlled to be OFF when the switch 413 is ON; it may be controlled to be ON when the switch 413 is OFF, thus obtaining the same effect.

Furthermore, when the switch 413 is replaced by a diode 404, as shown in FIG. 5, power supply from the power storage means 405 to the staple drive unit 410 and that from the power supply 401 of the image forming apparatus 401 can be automatically switched in accordance with the charge voltage Vc of the power storage means 405.

Also, if the image forming apparatus main body 301 can directly supply a voltage Vbo which satisfies Vbo>Va and Vbo≈Vb, as shown in FIG. 6, the power supply 401 of the main body may supply the voltage Vbo to the sheet processing apparatus. When the voltage Vbo is supplied to the power storage means 405 via the charge circuit 406 to charge it, the number of connectors (contacts) for power supply between the main body 301 and sheet processing apparatus 302 increases, but the charge circuit 406 need not boost the voltage Va to Vb(Vbo≈Vb), thus forming a low-cost charge circuit.

The process upon executing the staple operation by power supply from the power storage means will be described below with reference to the flowchart of FIG. 3.

When N transfer sheets, which are set in advance, are stacked on a stack tray 318, the sheet processing apparatus 302 starts the staple operation on the basis of the following flow. The sheet processing apparatus control circuit 409 monitors the charge voltage Vc of the power storage means 405 (step S701), and confirms if the charge voltage falls within a predetermined range (Vc1>Vc>Vc2) between a maximum charge voltage Vc1 and charge operation start voltage Vc2 shown in FIG. 2 (step S702). If the charge circuit 406 is configured to set Vc to be lower than Vc, only Vc>Vc2 may be confirmed, as shown in FIG. 3.

If it is confirmed that Vc falls within the predetermined range, the sheet processing apparatus control circuit 409 turns on the switch 413 in synchronism with the timing of the image forming operation to supply the voltage Vs to the staple drive unit 410 (step S703) and to drive the staple unit 312 via the staple drive unit 410, thus stapling a transfer sheet set 112*a* (step S704).

Figure 15:
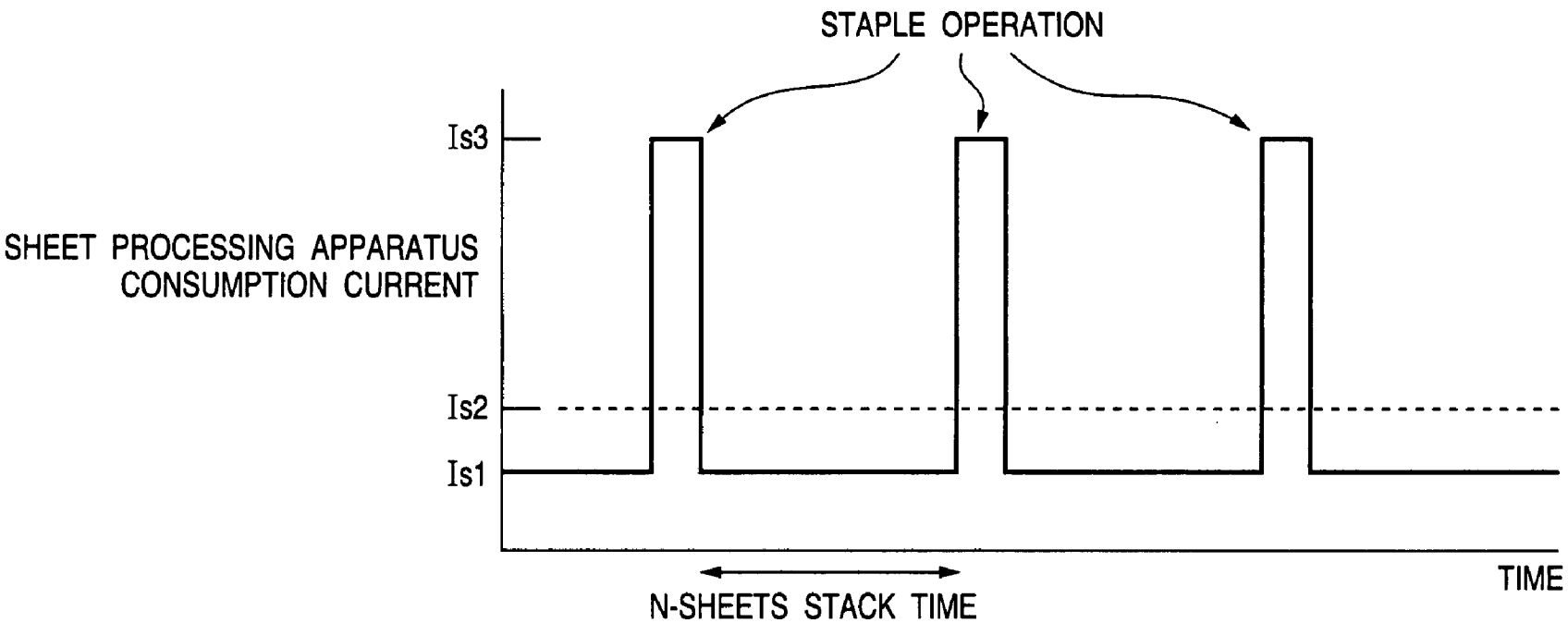
FIG. 15 is a graph showing a change in consumption current of the sheet processing apparatus.

In this embodiment, since the staple operation is executed by energy (electric power) stored in the power storage means 405, a maximum current (consumption current of the sheet processing apparatus) supplied from the power supply circuit 401 of the image forming apparatus to the sheet processing apparatus 302 in the staple operation can be reduced to be lower than the conventional value (Is3 in FIG. 15; about 5 A). For this reason, the consumption current of the sheet processing apparatus of this embodiment assumes a value as the sum of a current Is1 required for normal operations, and a current required to charge, and can be roughly reduced to a current value Is2 indicated by the broken line in FIG. 15. This means that the maximum current (maximum consumption current) that flows in the sheet processing apparatus is reduced, and the maximum consumption current of the system including the sheet processing apparatus and image forming apparatus is also reduced.

Upon completion of the staple operation, the switch 413 is turned off (step S705), and it is checked if a job is complete (step S706). If the job is not complete yet, the power storage means 405 is charged to prepare for the next staple operation (step S707); otherwise, the process ends.

If it is determined in step S706 that the job is not complete yet, and if the charge voltage Vc falls within the predetermined range (Vc1>Vc>Vc2), the power storage means need not always be charged, and the switch 413 need not always be turned off in step S705. That is, if the charge voltage Vc becomes lower than the charge operation start voltage Vc2, the switch 413 can be turned off to start charge.

On the other hand, if the charge voltage Vc is lower than the charge operation start voltage Vc2 in step S702, the voltage Vs required for the operation is unlikely to be supplied to the staple drive unit 410, i.e., the staple operation is unlikely to be executed depending on the conditions, e.g., the print speed, the number of sheets to be stapled, and the like. In such case, the image forming operation is paused (step S708), and the power storage means 405 is charged until its output voltage reaches the maximum voltage Vc1 (step S707).

Since the image forming operation is paused in step S708, consumption power of the voltage Va(≈Vs+Vf) internally consumed by the image forming apparatus is reduced. Since this reduction of consumption power can produce a margin in supply performance at the output voltage Va of the power supply 401 of the image forming apparatus, when that margin can supply electric power required for the staple operation, the image forming operation may be paused, and electric power may be supplied to the staple drive unit 410 via the diode 403 to execute the staple operation.

This embodiment has exemplified the arrangement in which the charge circuit 406 boosts the output voltage Va from the power supply 401 of the image forming apparatus to the charge circuit output voltage Vb to charge the power storage means 405, and the output voltage Vc of the power storage means 405 is stepped down to Vs by the constant voltage control circuit 408 to supply that voltage to the staple drive unit 410. However, other arrangements may be adopted.

For example, when the charge circuit 406 is replaced by a simple switch circuit, the output voltage Va from the power supply 401 of the main body may be set to be nearly equal to the output voltage Vb of the charge circuit 406 to charge the power storage means 405, and the output voltage Vc of the power storage means 405 may be boosted to Vs by the constant voltage control circuit 408 so as to be supplied to the staple drive unit 410, thus implementing the same control as in this embodiment.

As described above, according to this embodiment, in the system in which the power supply of the image forming apparatus supplies electric power to the sheet processing apparatus, the sheet processing apparatus includes the power storage means, and the staple operation is executed using electric power supplied from the power storage means. Hence, power supply to be supplied from the power supply of the main body can be reduced upon execution of the staple operation. An increase in cost of the image forming apparatus itself can be minimized, and an inexpensive image forming apparatus can be provided to users who do not require any sheet processing apparatus.

Second Embodiment

The second embodiment according to the present invention will be described below. The second embodiment is directed to the system including the image forming apparatus and sheet processing apparatus as in the first embodiment. In the following description, a description of the same part as in the first embodiment will be omitted, and a characteristic part of this embodiment will be mainly explained.

In the first embodiment, when the set number of transfer sheets to be stapled changes, the operation remains the same. However, this embodiment is characterized in that whether or not the staple operation is feasible is checked in accordance with the set number of transfer sheets to be stapled and the charge voltage.

Figure 7:
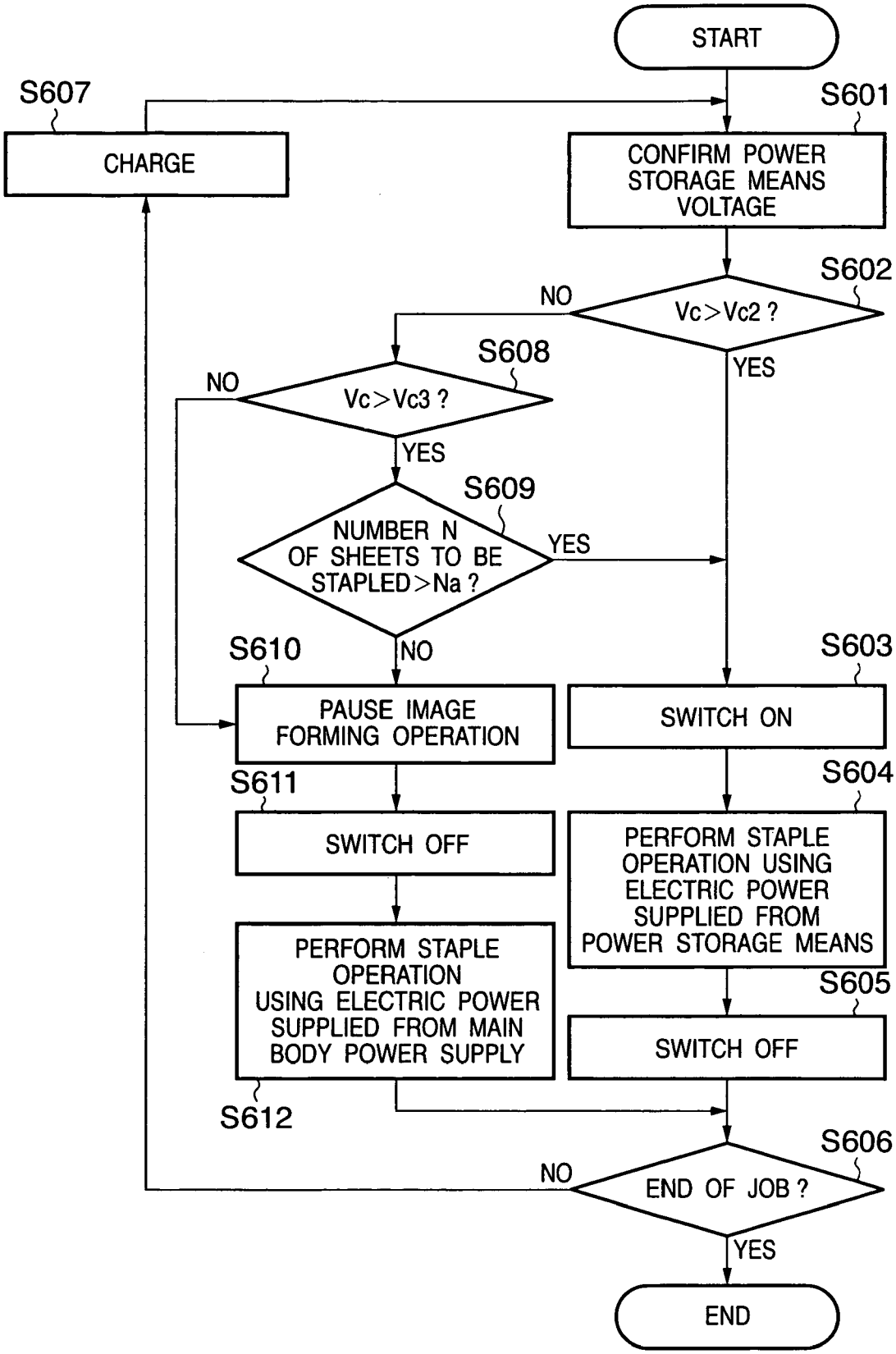
FIG. 7 is a flowchart of a staple process of the second embodiment.

The process executed upon performing the staple operation using electric power supplied from the power storage means in this embodiment will be described below with reference to FIG. 7.

When N transfer sheets, which are set in advance, are stacked on a stack tray 318, the sheet processing apparatus 302 starts the staple operation on the basis of the following flow. The sheet processing apparatus control circuit 409 monitors the charge voltage Vc of the power storage means (step S601), and confirms if the charge voltage falls within a predetermined range (Vc1>Vc>Vc2) between a maximum charge voltage Vc1 and charge operation start voltage Vc2 shown in FIG. 2 (step S602). If the charge circuit 406 is configured to set Vc to be lower than Vc, only Vc>Vc2 may be confirmed, as shown in FIG. 7.

If it is confirmed that Vc falls within the predetermined range, the sheet processing apparatus control circuit 409 turns on the switch 413 in synchronism with the timing of the image forming operation to supply the voltage Vs to the staple drive unit 410 (step S603) and to drive the staple unit 312 via the staple drive unit 410, thus stapling a transfer sheet set 112*a* (step S604).

In this embodiment, since the staple operation is executed by energy (electric power) stored in the power storage means 405, a maximum current (consumption current of the sheet processing apparatus) supplied from the power supply circuit 401 of the image forming apparatus to the sheet processing apparatus 302 in the staple operation can be reduced to be lower than the conventional value (Is3 in FIG. 15; about 5 A). For this reason, the consumption current of the sheet processing apparatus of this embodiment assumes a value as the sum of a current Is1 required for normal operations, and a current required to charge, and can be roughly reduced to a current value Is2 indicated by the broken line in FIG. 15. This means that the maximum current (maximum consumption current) that flows in the sheet processing apparatus is reduced, and the maximum consumption current of the system including the sheet processing apparatus and image forming apparatus is also reduced.

Upon completion of the staple operation, the switch 413 is turned off (step S605), and it is checked if a job is complete (step S606). If the job is not complete yet, the power storage means 405 is charged to prepare for the next staple operation (step S607); otherwise, the process ends.

If it is determined in step S606 that the job is not complete yet, and if the charge voltage Vc falls within the predetermined range (Vc1>Vc>Vc2), the power storage means need not always be charged, and the switch 413 need not always be turned off in step S605. That is, if the charge voltage Vc becomes lower than the charge operation start voltage Vc2, the switch 413 can be turned off to start charge.

On the other hand, if the charge voltage Vc is lower than the charge operation start voltage Vc2 in step S602, the voltage Vs required for the operation is unlikely to be supplied to the staple drive unit 410, i.e., the staple operation is unlikely to be executed depending on the conditions, e.g., the print speed, the number of sheets to be stapled, and the like. In such case, it is checked if the charge voltage Vc exceeds a voltage Vc3 (step S608).

Note that the voltage Vc3 assumes a value which is determined in advance in correspondence with the number N of sheets per set of the transfer sheet set 112*a*. For example, when the number of sheets per set of the transfer sheet set 112*a* is Na, the voltage Vc3 is determined so that the time required to stack Na transfer sheets, and the time required until the voltage starting to be charged from the Vc3 reaches the charge start voltage Vc2 or more become equal, as shown in FIG. 2. More specifically, if Vc>Vc3 and N>Na, the voltage of the power storage means is charged to a value that exceeds Vc2 between the two staple operations.

Hence, if Vc>Vc3, it is checked if N>Na (step S609). If N>Na, the flow advances to step S603 to execute the subsequent processes in the same manner as described above.

On the other hand, if it is determined in step S609 that N≦Na, this means that the voltage of the power storage means cannot be charged to a value that exceeds Vc2 during the staple operation. Hence, since the staple operation is unlikely to be executed, the image forming operation is paused (step S610) to reduce consumption power of the voltage Va(≈Vs+Vf) internally consumed by the image forming apparatus. Since this reduction of consumption power can produce a margin in supply performance at the output voltage Va of the power supply 401 of the image forming apparatus, the switch 413 is turned off (step S611) to supply electric power required for the staple operation from the power supply 401 of the image forming apparatus to the staple drive unit 410 via the diode 403, thus executing the staple operation (step S612).

If it is determined in step S608 that Vc≦Vc3, the flow jumps to step S610 to pause the image forming operation, and to supply electric power required for the staple operation from the power supply 401 of the image forming apparatus to the staple drive unit 410 via the diode 403, thus executing the staple operation.

As described above, according to this embodiment, in addition to the same effect as in the first embodiment, even when the charge voltage of the power storage means is insufficient, if the number of sheets to be stapled is less than a predetermined value, the staple operation by the sheet processing apparatus can be executed without pausing the image forming operation, thereby improving the system operating rate.

Third Embodiment

The third embodiment according to the present invention will be described below. The third embodiment is directed to the system including the image forming apparatus and sheet processing apparatus as in the first and second embodiments. In the following description, a description of the same part as in the first and second embodiments will be omitted, and a characteristic part of this embodiment will be mainly explained.

In this embodiment, whether or not the staple operation is feasible is checked in correspondence with the set number of transfer sheets to be stapled, and the charge voltage as in the second embodiment. However, this embodiment is characterized in that when the set number of transfer sheets to be stapled is small, and the time required to stack set sheets is shorter than the time required until the voltage of the power storage means reaches a predetermined voltage, the operation is slowed down without pausing the image forming operation.

Figure 8:
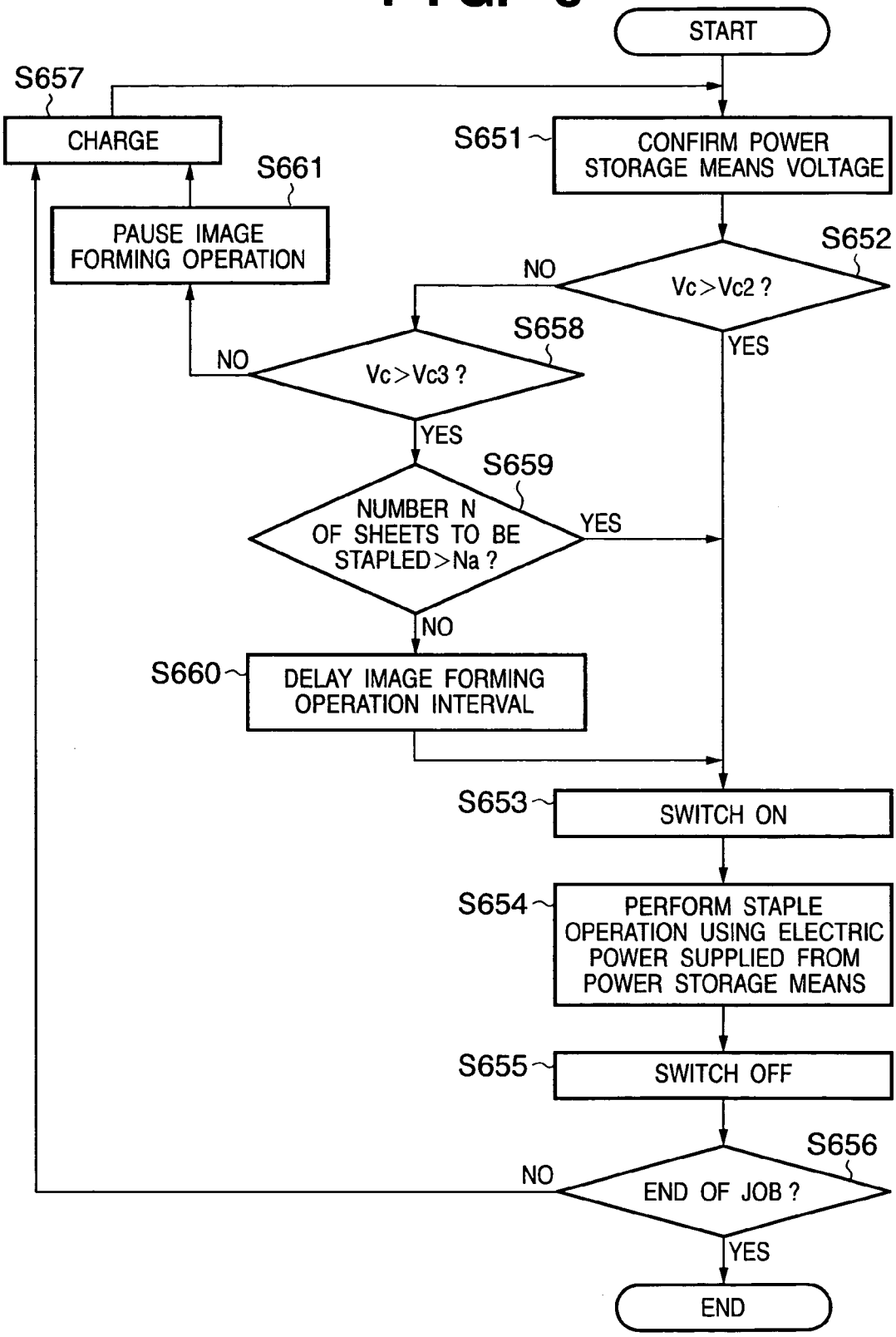
FIG. 8 is a flowchart of a staple process of the third embodiment.
Figure 9:
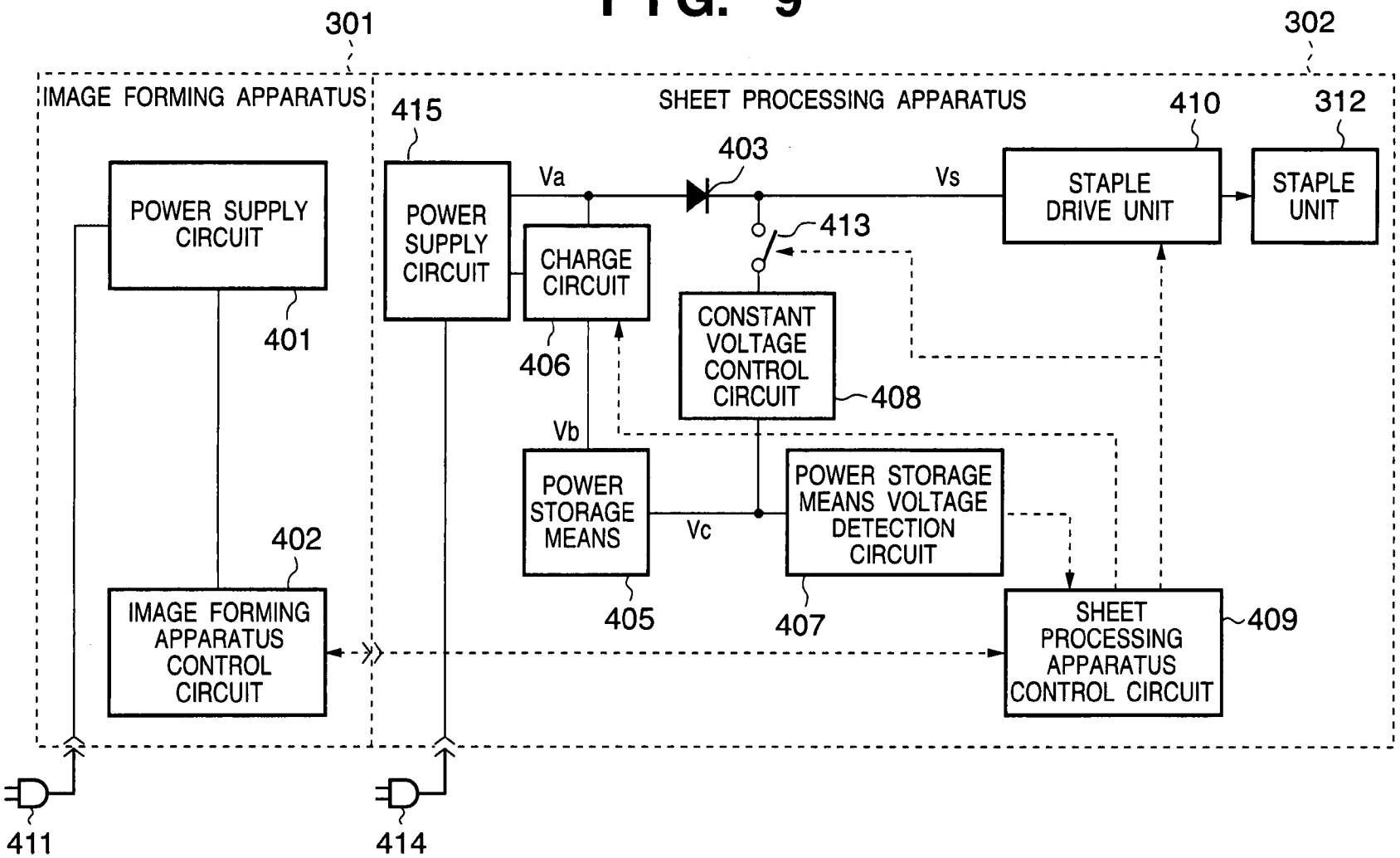
FIG. 9 is a block diagram showing the electrical arrangement of an image forming apparatus and sheet processing apparatus according to the fourth embodiment of the present invention.
Figure 10:
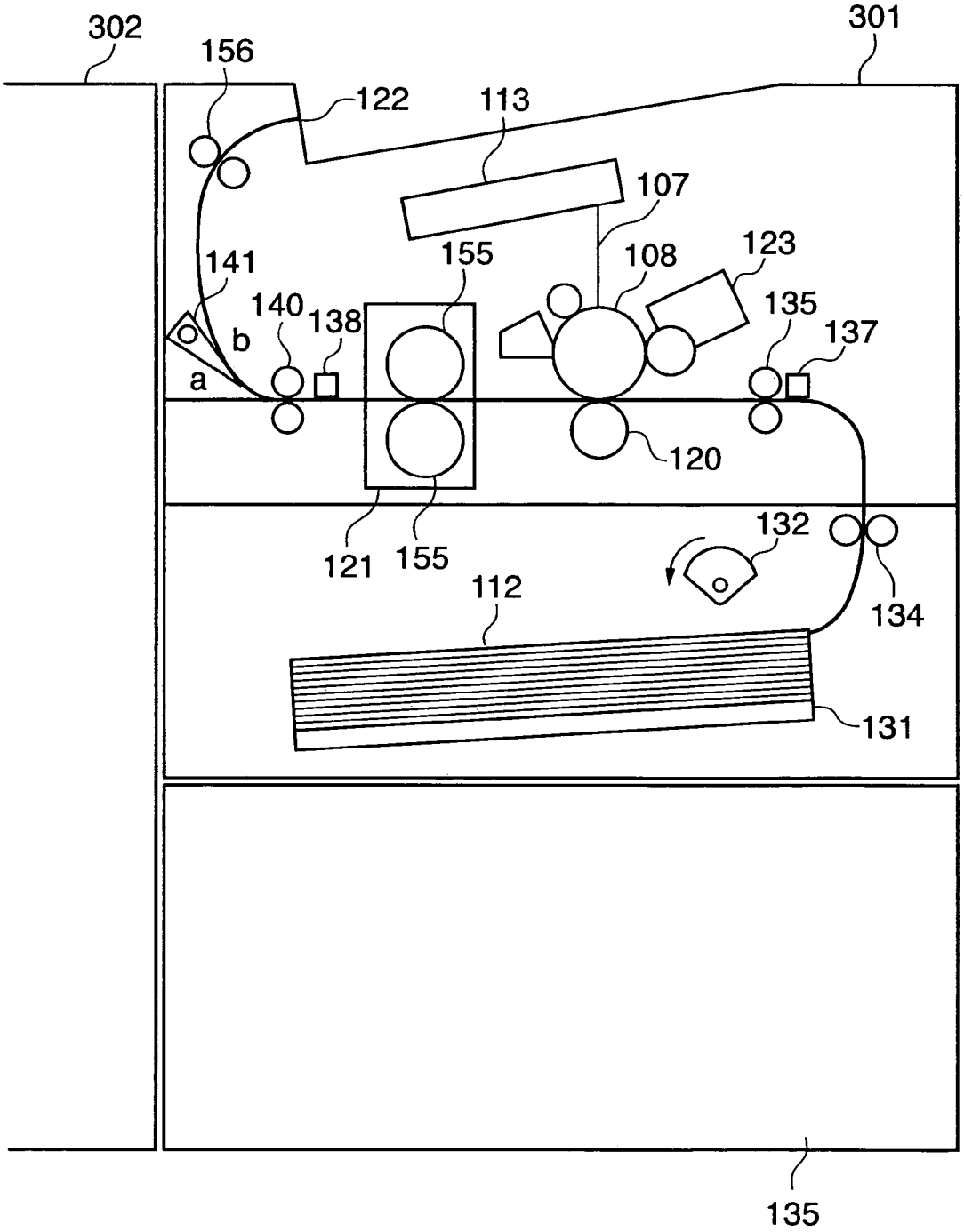
FIG. 10 is a schematic sectional view showing the structure of a general image forming apparatus.
Figure 11:
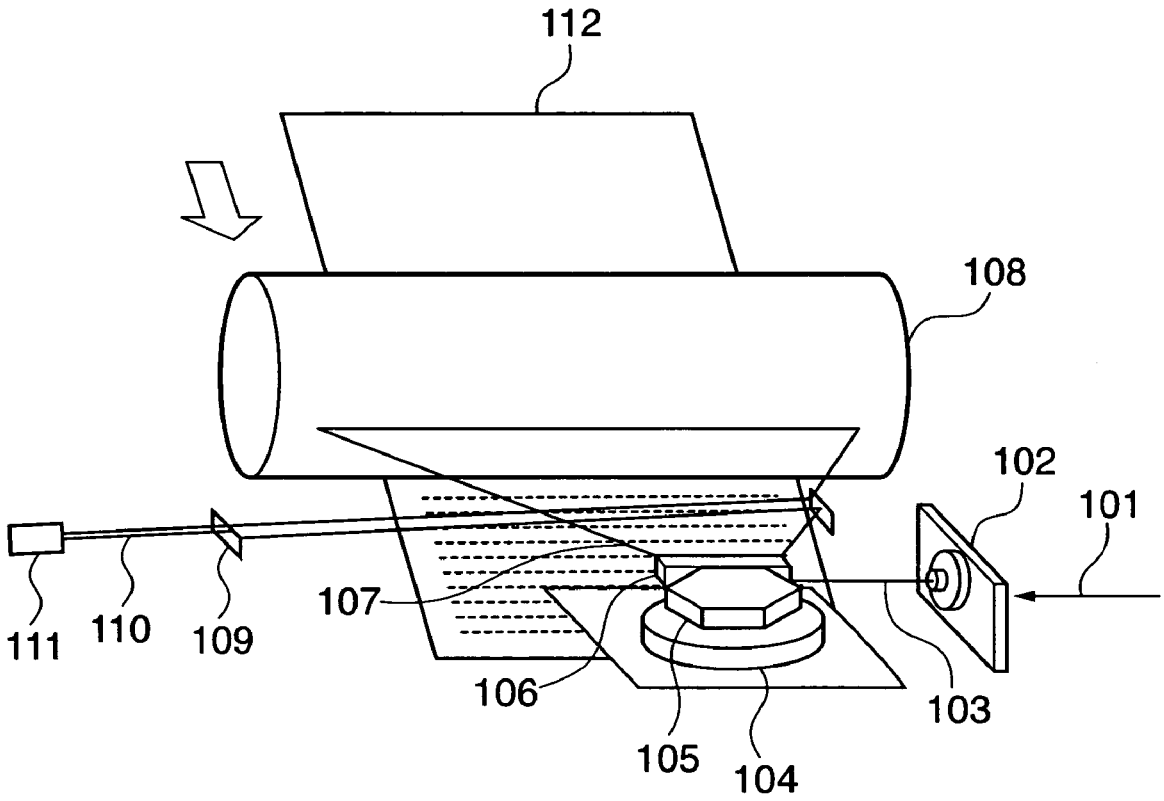
FIG. 11 is a view for explaining the arrangement of a scanner unit of the image forming apparatus shown in FIG. 10.
Figure 12:
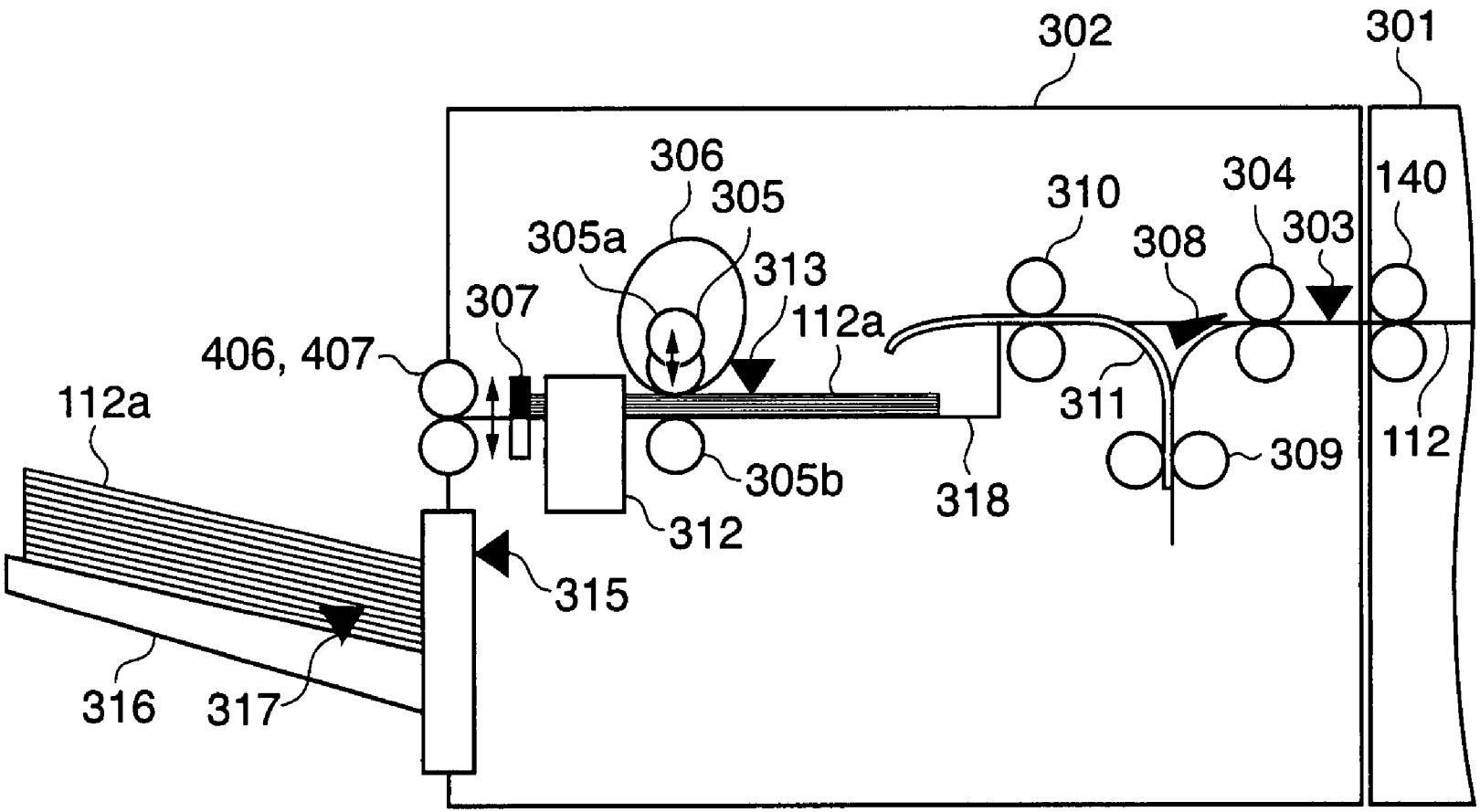
FIG. 12 is a schematic sectional view showing the structure of a general sheet processing apparatus.
Figure 13:
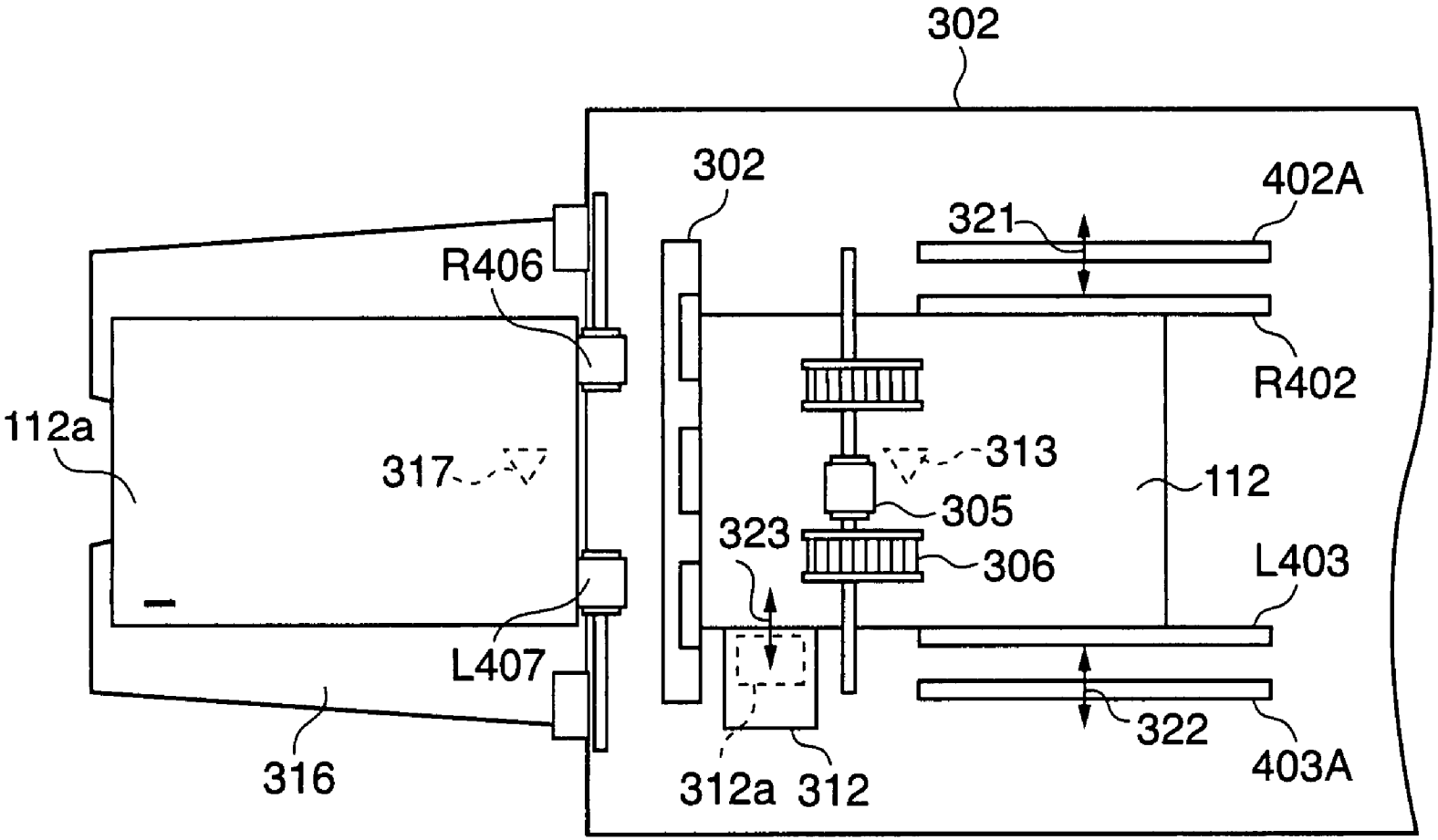
FIG. 13 is a top view of the sheet processing apparatus shown in FIG. 12.
Figure 14:
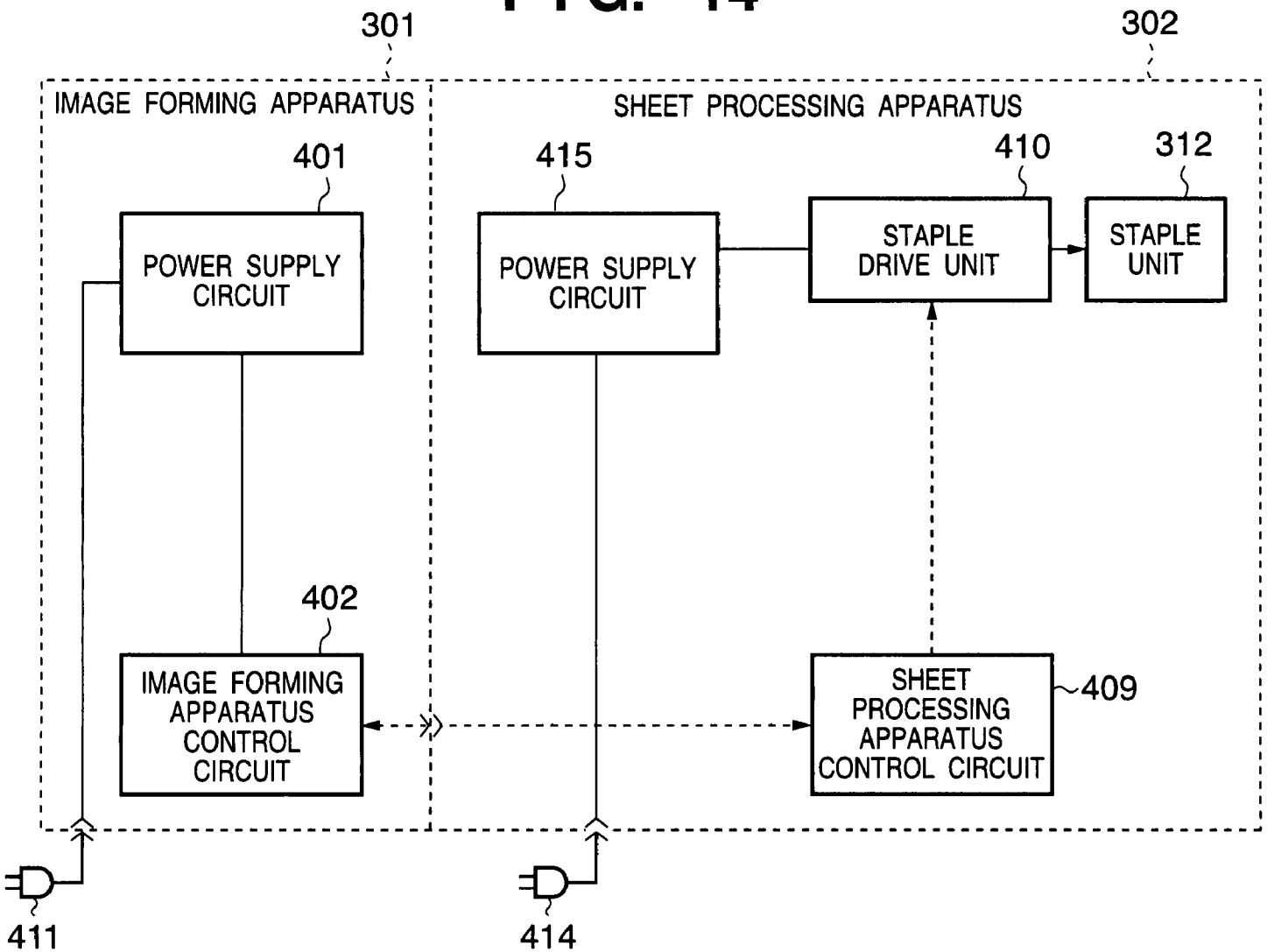
FIG. 14 is a block diagram showing an example of the electrical arrangement of the image forming apparatus and sheet processing apparatus.

The process executed upon performing the staple operation using electric power supplied from the power storage means in this embodiment will be described below with reference to FIG. 8.

When N transfer sheets, which are set in advance, are stacked on a stack tray 318, the sheet processing apparatus 302 starts the staple operation on the basis of the following flow. The sheet processing apparatus control circuit 409 monitors the charge voltage Vc of the power storage means (step S651), and confirms if the charge voltage falls within a predetermined range (Vc1>Vc>Vc2) between a maximum charge voltage Vc1 and charge operation start voltage Vc2 shown in FIG. 2 (step S652). If the charge circuit 406 is configured to set Vc to be lower than Vc, only Vc>Vc2 may be confirmed, as shown in FIG. 8.

If it is confirmed that Vc falls within the predetermined range, the sheet processing apparatus control circuit 409 turns on the switch 413 in synchronism with the timing of the image forming operation to supply the voltage Vs to the staple drive unit 410 (step S653) and to drive the staple unit 312 via the staple drive unit 410, thus stapling a transfer sheet set 112*a* (step S654).

In this embodiment, since the staple operation is executed by energy (electric power) stored in the power storage means 405, a maximum current (consumption current of the sheet processing apparatus) supplied from the power supply circuit 401 of the image forming apparatus to the sheet processing apparatus 302 in the staple operation can be reduced to be lower than the conventional value (Is3 in FIG. 15; about 5 A). For this reason, the consumption current of the sheet processing apparatus of this embodiment assumes a value as the sum of a current Is1 required for normal operations, and a current required to charge, and can be roughly reduced to a current value Is2 indicated by the broken line in FIG. 15. This means that the maximum current (maximum consumption current) that flows in the sheet processing apparatus is reduced, and the maximum consumption current of the system including the sheet processing apparatus and image forming apparatus is also reduced.

Upon completion of the staple operation, the switch 413 is turned off (step S655), and it is checked if a job is complete (step S656). If the job is not complete yet, the power storage means 405 is charged to prepare for the next staple operation (step S657); otherwise, the process ends.

If it is determined in step S656 that the job is not complete yet, and if the charge voltage Vc falls within the predetermined range (Vc1>Vc>Vc2), the power storage means need not always be charged, and the switch 413 need not always be turned off in step S655. That is, if the charge voltage Vc becomes lower than the charge operation start voltage Vc2, the switch 413 can be turned off to start charge.

On the other hand, if the charge voltage Vc is lower than the charge operation start voltage Vc2 in step S652, the voltage Vs required for the operation is unlikely to be supplied to the staple drive unit 410, i.e., the staple operation is unlikely to be executed depending on the conditions, e.g., the print speed, the number of sheets to be stapled, and the like. In such case, it is checked if the charge voltage Vc exceeds a voltage Vc3 (step S658).

Note that the voltage Vc3 assumes a value which is determined in advance in correspondence with the number N of sheets per set of the transfer sheet set 112*a*. For example, when the number of sheets per set of the transfer sheet set 112*a* is Na, the voltage Vc3 is determined so that the time required to stack Na transfer sheets, and the time required until the voltage starting to be charged from the Vc3 reaches the charge start voltage Vc2 or more become equal, as shown in FIG. 2. More specifically, if Vc>Vc3 and N>Na, the voltage of the power storage means is charged to a value that exceeds Vc2 between the two staple operations.

Hence, if Vc>Vc3, it is checked if N>Na (step S659). If N>Na, the flow advances to step S653 to execute the subsequent processes in the same manner as described above.

On the other hand, if it is determined in step S659 that N≦Na, this means that the voltage of the power storage means cannot be charged to a value that exceeds Vc2 during the staple operation. Hence, the image forming apparatus control circuit 402 controls to delay the image forming operation interval (step S660) so as to broaden the time interval of transfer sheets 112 to be stacked on the stack tray 318, thereby setting the time required to stack N transfer sheets, which are set in advance, to be longer than the time required until the power storage means is charged with a voltage that exceeds the charge start voltage Vc2. That is, the operation interval of the image forming operation is set so that the voltage is charged to a value that exceeds Vc2 during the staple operation. After that, the flow advances to step S653 to execute the staple operation in the same manner as described above.

If it is determined in step S658 that Vc≦Vc3, the image forming operation is paused (step S661), and the power storage means 405 is charged (step S657).

As described above, according to this embodiment, in addition to the same effect as in the first embodiment, even when the charge voltage of the power storage means is insufficient, if the charge voltage of the power storage means is equal to or higher than a predetermined value, the staple operation by the sheet processing apparatus can be executed without pausing the image forming operation, thereby improving the system operating rate.

Fourth Embodiment

The fourth embodiment according to the present invention will be described below. The fourth embodiment is directed to the system including the image forming apparatus and sheet processing apparatus as in the first to third embodiments. In the following description, a description of the same part as in the first to third embodiments will be omitted, and a characteristic part of this embodiment will be mainly explained.

In the first to third embodiments, only the image forming apparatus comprises the power supply circuit, but the sheet processing apparatus does not comprise any power supply circuit. However, this embodiment is characterized in that both the image forming apparatus and sheet processing apparatus respectively have power supply circuits.

This embodiment will be explained below with reference the block diagram that shows the electrical arrangement of the image forming apparatus and sheet processing apparatus of this embodiment.

A power supply circuit 401 arranged in an image forming apparatus 301 supplies a predetermined voltage to an image forming apparatus control circuit 402 that controls image formation. The image forming apparatus control circuit 402 communicates, via a connector, with a sheet processing apparatus control circuit 409, which is arranged in the sheet processing apparatus 302, and controls the convey and staple operations of transfer sheets in the sheet processing apparatus, thus making timing control so that the convey and staple operations of transfer sheets 112 conveyed from the image forming apparatus 301 can be made smoothly.

On the other hand, a power supply circuit 415 is arranged in the sheet processing apparatus, and supplies electric power required for the convey and staple operations of transfer sheets in the sheet processing apparatus. Reference numeral 406 denotes a charge circuit, which receives a predetermined voltage Va supplied from the power supply circuit 415, supplies a predetermined voltage Vb(Va<Vb) to a power storage means 405 including a plurality of electric double layer capacitors in accordance with a charge command from the sheet processing apparatus control circuit 409, and changes until the output voltage of the power storage means reaches a predetermined voltage Vc(≈Vb). The electric double layer capacitor has received a lot of attention in many fields in recent years, since it has a capacitance as large as several F or more, higher charge efficiency than a secondary battery, and a long life.

A power storage means voltage detection circuit 407 detects the charge voltage of the power storage means 405, and transmits the detection result to an A/D port of a CPU (not shown) in the sheet processing apparatus control circuit 409 as, e.g., an analog signal. According to this voltage detection result of the power storage means, the sheet processing apparatus control circuit 409 supplies a charge instruction to the charge circuit 406. A constant voltage control circuit 408 controls the charge voltage Vc of the power storage means 405 to be equal to or higher than a voltage Vs(Vs≈Va−Vf, Vs<Vc, Vf=forward voltage of a diode 403: about 0.6 V), and supplies the voltage Vs to a staple drive unit 410 via a switch 413, thereby driving a staple unit 312.

As the switch 413, a semiconductor switch such as a FET or the like is preferably used in terms of durability of ON/OFF operations. However, a mechanical switch such as a relay or the like may be used if it does not pose any problem in a service life such as ON/OFF counts and the like. The diode 403 is provided to prevent the output from the power supply circuit 415 from being supplied to the staple drive circuit 410 while the voltage Vs is supplied from the power storage means 405 via the constant voltage control circuit 408.

The sheet processing apparatus executes the staple operation on the basis of the flow shown in FIG. 3, that has been explained in association with the first embodiment. That is, electric power stored in the power storage means is supplied to the staple unit to execute the staple operation, thereby reducing peak electric power to be supplied from the power supply circuit 415 in the sheet processing apparatus upon execution of the staple operation.

Since the maximum output power of the power supply circuit 415 of the sheet processing apparatus is nearly proportional to electric power supplied from the commercial power supply via an AC plug connected to the power supply circuit 415, the maximum consumption power of the sheet processing apparatus can be reduced. As a result, the maximum consumption power of the system including the image forming apparatus and sheet processing apparatus can be reduced.

As described above, according to this embodiment, since the maximum consumption power of the sheet processing apparatus can be reduced, no problem is posed even when the AC plugs of the image forming apparatus main body and sheet processing apparatus are connected to the same commercial power supply system. Hence, no expert such as a service person or the like who has special knowledge is required, and system installation is facilitated. In addition, when electric power that can be supplied from the commercial power supply has a margin for the maximum consumption power of the system by reducing the maximum consumption power of the sheet processing apparatus, electric power to be supplied to the image forming apparatus can be further increased to be effectively utilized in improvement of specifications, thus allowing design changes.

Other Embodiments

In the first to fourth embodiments, the electric double layer capacitors are used as an example of the power storage means. Alternatively, a plurality of electrolytic capacitors such as large-capacity aluminum electrolytic capacitors or a secondary battery such as a nickel-metal-hydride battery, lithium battery, and the like may be used as the power storage means by limiting the use conditions or in consideration of a sequence and the like. However, when the secondary battery is used as the power storage means, since the secondary battery normally suffers a short life time (e.g., a charge/discharge count or the like), it must be arranged as an exchangeable part which can be detached from the sheet processing apparatus.

In the above embodiments, the apparatus that applies the staple process as a post-process to printed sheets (that have undergone image formation) has been exemplified as the sheet processing apparatus. However, the present invention can be applied to sheet processing apparatuses that apply other post-processes. As other post-processes, for example, a trimming process, booklet process, and the like of sheets may be used. In this case, if execution of such post-process instantaneously requires large electric power, the same effects as those in the above embodiments can be obtained.

The present invention may be applied to a system including a plurality of apparatuses (image forming apparatus and sheet processing apparatus), or an apparatus consisting of a single device such as a sheet processing apparatus, an apparatus that integrates an image forming apparatus and sheet processing apparatus, an image processing apparatus having a function of a sheet processing apparatus, and the like.

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or scrip data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

If the present invention is realized as a storage medium, program codes corresponding to at least one of the above mentioned flowcharts (FIGS. 3, 7 and 8) is to be stored in the storage medium.

As many apparently widely different embodiments of the present invention can be made without departing from the spirit and scope thereof, it is to be understood that the invention is not limited to the specific embodiments thereof except as defined in the claims.

CLAIM OF PRIORITY

This application claims priority from Japanese Patent Application No. 2004-031403 filed on Feb. 6, 2004, which is hereby incorporated by reference herein.

What is claimed is:

1. A sheet processing apparatus, which is connected to an image forming apparatus and applies a predetermined process to a plurality of sheets that have undergone image formation as a unit, comprising:

a power storage unit capable of storing electric power for executing the predetermined process;

a charge circuit for charging said power storage unit with electric power;

a detection circuit for detecting an output voltage of said power storage unit; and a control circuit for outputting a signal to the image forming apparatus to pause an image forming operation in order to delay a time to execute control for controlling the predetermined process based on the output voltage detected by said detection circuit.

2. The sheet processing apparatus according to claim 1, wherein said charge circuit is configured to charge said power storage unit with electric power supplied from the image forming apparatus.

3. The sheet processing apparatus according to claim 1, further comprising:

a power supply circuit for generating internally required electric power from a commercial power supply, and wherein said charge circuit is configured to charge said power storage unit with electric power supplied from said power supply circuit.

4. The sheet processing apparatus according to claim 1, wherein a route of the electric power supplied from said power storage unit is controlled so as to prevent the charge process on said power storage unit by said charge circuit, and execution of the predetermined process from being made at the same time.

5. The sheet processing apparatus according to claim 1, wherein when the output voltage detected by said detection circuit is not greater than a first predetermined value, and when the detected output voltage exceeds a second predetermined value less than the first predetermined value and the number of sheets as the unit exceeds a predetermined number, said control circuit controls to execute the predetermined process.

6. The sheet processing apparatus according to claim 5, wherein when the output voltage detected by said detection circuit is not greater than the first predetermined value, and when the detected output voltage exceeds the second predetermined value less than the first predetermined value or the number of sheets as the unit is not greater than the predetermined number, said control circuit instructs the image forming apparatus to pause the image forming operation, and then executes the predetermined process using the electric power supplied to said charge circuit.

7. The sheet processing apparatus according to claim 5, wherein when the output voltage detected by said detection circuit is not greater than the first predetermined value, and when the detected output voltage exceeds the second predetermined value less than the first predetermined value and the number of sheets as the unit is not greater than the predetermined number, said control circuit instructs the image forming apparatus to delay the image forming operation, and then executes the predetermined process.

8. The sheet processing apparatus according to claim 1, wherein the predetermined process is one of a staple process for stapling the plurality of sheets, a trimming process for trimming the plurality of sheets, and a booklet process for bookbinding the plurality of sheets.

9. The sheet processing apparatus according to claim 1, wherein said power storage unit comprises a capacitor or a secondary battery.

10. The sheet processing apparatus according to claim 9, wherein the capacitor comprises an electric double layer capacitor.

11. An image forming apparatus comprising:

a sheet processing apparatus that applies a predetermined process to a plurality of sheets that have undergone image formation as a unit comprising:

a power storage unit capable of storing electric power for executing the predetermined process;

a charge circuit for charging said power storage unit with electric power;

a detection circuit for detecting an output voltage of said power storage unit; and a control circuit for outputting a signal to the image forming apparatus to pause an image forming operation in order to delay a time to execute control for controlling the predetermined process based on the output voltage detected by said detection circuit; and an image forming unit, wherein the image forming apparatus pauses the image forming operation based on the signal output from said control circuit of the sheet processing apparatus.

12. The image forming apparatus according to claim 11, wherein said charge circuit is configured to charge said power storage unit with electric power supplied from the image forming apparatus, and the image forming apparatus pauses the image forming operation based on the signal output from said control circuit of the sheet processing apparatus.

13. The image forming apparatus according to claim 11, further comprising a power supply circuit for generating internally required electric power from a commercial power supply, wherein said charge circuit is configured to charge said power storage unit with electric power supplied from said power supply circuit, and the image forming apparatus pauses the image forming operation based on the signal output from said control circuit of the sheet processing apparatus.

14. The image forming apparatus according to claim 11, wherein a route of the electric power supplied from said power storage unit is controlled so as to prevent the charge process on said power storage unit by said charge circuit, and execution of the predetermined process from being made at the same time, and the image forming apparatus pauses the image forming operation based on the signal output from said control circuit of the sheet processing apparatus.

15. The image forming apparatus according to claim 11, wherein when the output voltage detected by said detection circuit is not greater than a first predetermined value, and when the detected output voltage exceeds a second predetermined value less than the first predetermined value and the number of sheets as the unit exceeds a predetermined number, said control circuit controls to execute the predetermined process, and the image forming apparatus pauses the image forming operation based on the signal output from said control circuit of the sheet processing apparatus.

16. The image forming apparatus according to claim 15, wherein when the output voltage detected by said detection circuit is not greater than the first predetermined value, and when the detected output voltage exceeds the second predetermined value less than the first predetermined value or the number of sheets as the unit is not greater than the predetermined number, said control circuit instructs the image forming apparatus to pause the image forming operation, and then executes the predetermined process using the electric power supplied to said charge circuit, and the image forming apparatus pauses the image forming operation based on the signal output from said control circuit of the sheet processing apparatus.

17. The image forming apparatus according to claim 15, wherein when the output voltage detected by said detection circuit is not greater than the first predetermined value, and when the detected output voltage exceeds the second predetermined value less than the first predetermined value and the number of sheets as the unit is not greater than the predetermined number, said control circuit instructs the image forming apparatus to delay the image forming operation, and then executes the predetermined process, and the image forming apparatus pauses the image forming operation based on the signal output from said control circuit of the sheet processing apparatus.

18. The image forming apparatus according to claim 11, wherein the predetermined process is one of a staple process for stapling the plurality of sheets, a trimming process for trimming the plurality of sheets, and a booklet process for bookbinding the plurality of sheets, and the image forming apparatus pauses the image forming operation based on the signal output from said control circuit of the sheet processing apparatus.

19. The image forming apparatus according to claim 11, wherein said power storage unit comprises a capacitor or a secondary battery, and the image forming apparatus pauses the image forming operation based on the signal output from said control circuit of the sheet processing apparatus.

20. The image forming apparatus according to claim 19, wherein the capacitor comprises an electric double layer capacitor, and the image forming apparatus pauses the image forming operation based on the signal output from said control circuit of the sheet processing apparatus.

* * * * *

UNITED STATES PATENT AND TRADEMARK OFFICE

CERTIFICATE OF CORRECTION

PATENT NO. : 7,224,920 B2
APPLICATION NO. : 11/044293
DATED : May 29, 2007
INVENTOR(S) : Satoru Koyama It is certified that error appears in the above-identified patent and that said Letters Patent is hereby corrected as shown below:

ON THE TITLE PAGE:
At Item (30), Foreign Application Priority Data, "Feb 6, 2003" should read --Feb. 6, 2004--.
At Item (57), Abstract, Line 1, "In a" should read --A--.

COLUMN 13:
Line 10, "consumption power" should read --power consumption--.

COLUMN 19:
Line 55, "comprising" should read --comprising:--.

Signed and Sealed this

Twenty-seventh Day of November, 2007

JON W. DUDAS
*Director of the United States Patent and Trademark Office*